US010429753B2

(12) United States Patent
Watariguchi et al.

(10) Patent No.: US 10,429,753 B2
(45) **Date of Patent: *Oct. 1, 2019**

(54) ELECTROPHOTOGRAPHIC PHOTOCONDUCTOR, PROCESS CARTRIDGE, AND ELECTROPHOTOGRAPHIC APPARATUS

(71) Applicant: CANON KABUSHIKI KAISHA, Tokyo (JP)

(72) Inventors: Kaname Watariguchi, Yokohama (JP); Masato Tanaka, Tagata-gun (JP); Masataka Kawahara, Mishima (JP); Jumpei Kuno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/053,914

(22) Filed: Feb. 25, 2016

(65) Prior Publication Data

US 2016/0252834 A1 Sep. 1, 2016

(30) Foreign Application Priority Data

Feb. 27, 2015 (JP) ..... 2015-039415

(51) Int. Cl.
*G03G 5/06* (2006.01)
*G03G 5/047* (2006.01)
*G03G 5/14* (2006.01)

(52) U.S. Cl.
CPC ..... *G03G 5/0696* (2013.01); *G03G 5/047* (2013.01); *G03G 5/142* (2013.01)

(58) Field of Classification Search
CPC .. G03G 5/05; G03G 5/06; G03G 5/14; G03G 5/0696; G03G 5/047
See application file for complete search history.

(56) References Cited

U.S. PATENT DOCUMENTS 9,436,106 B2 * 9/2016 Kuno ..... G03G 15/00
9,645,516 B2 * 5/2017 Kawahara ..... G03G 5/0696
(Continued)

FOREIGN PATENT DOCUMENTS

JP 2003-330209 A 11/2003
JP 2003330209 * 11/2003 ..... G03G 5/14
(Continued)

OTHER PUBLICATIONS

Machine English language translation of JP-2003330209, dated Nov. 19, 2003.*

*Primary Examiner* — Christopher D Rodee
(74) *Attorney, Agent, or Firm* — Canon U.S.A., Inc. IP Division

(57) ABSTRACT

An electrophotographic photoconductor comprises a support, an undercoat layer, a charge generation layer, and a hole transport layer in this order. The undercoat layer comprises an electron transport substance, and the charge generation layer comprises a gallium phthalocyanine crystal and an amide compound represented by formula (N1):

Formula (N1)

where $R^1$ represents a methyl group, a propyl group, or a vinyl group.

8 Claims, 4 Drawing Sheets

(56) References Cited

U.S. PATENT DOCUMENTS

| | | | | |
|---|---|---|---|---|
| 9,709,907 | B2 * | 7/2017 | Watariguchi | G03G 5/0638 |
| 9,753,385 | B2 * | 9/2017 | Ito | G03G 5/0564 |
| 2014/0170540 | A1 * | 6/2014 | Tanaka | G03G 5/0542<br>430/56 |
| 2014/0377701 | A1 * | 12/2014 | Okuda | G03G 5/14<br>430/130 |
| 2014/0377703 | A1 * | 12/2014 | Ogaki | G03G 5/14<br>430/131 |

FOREIGN PATENT DOCUMENTS

| | | | |
|---|---|---|---|
| JP | 2010-145506 | A | 7/2010 |
| JP | 2012-32781 | A | 2/2012 |

* cited by examiner

ELECTROPHOTOGRAPHIC PHOTOCONDUCTOR, PROCESS CARTRIDGE, AND ELECTROPHOTOGRAPHIC APPARATUS

BACKGROUND OF THE INVENTION

Field of the Invention

The present invention relates to an electrophotographic photoconductor, a process cartridge including an electrophotographic photoconductor, and an electrophotographic apparatus including an electrophotographic photoconductor.

Description of the Related Art

Presently, the oscillation wavelength of semiconductor lasers commonly used as the device for image exposure in the field of electrophotography is as long as about 650 to 820 nm, and development of electrophotographic photoconductors that have high sensitivity for such long-wavelength light has been pursued. Also pursued is the development of electrophotographic photoconductors that have high sensitivity for light of semiconductor lasers whose oscillation wavelength is short in order to further increase image resolution.

Phthalocyanine pigments are known to serve as charge-generation substances that have high sensitivity for light from such a long-wavelength range to such a short-wavelength range. In particular, oxytitanium phthalocyanine and gallium phthalocyanine have excellent sensitivity properties and various crystal forms have been reported to date.

However, electrophotographic photoconductors that use gallium phthalocyanine pigments generate a large number of photocarriers (holes and electrons) and thus electrons that pair with holes that have migrated through the hole transport substances tend to remain in photosensitive layers (charge generation layers). Thus, electrophotographic photoconductors that use gallium phthalocyanine pigments frequently encounter a phenomenon known as ghosting. Specifically, positive ghosting in which only the portions irradiated with light in the previous run appear dense and negative ghosting in which only the portions irradiated with light in the previous run appear sparse are observed in output images.

Japanese Patent Laid-Open No. 2012-32781 reports that ghosting can be addressed by adding a particular amine compound to a charge generation layer.

In order to withdraw electrons from a charge generation layer and reduce charge injection from a support to a photosensitive layer side, an electron transport substance has been added to an undercoat layer or an intermediate layer so that this layer functions as an electron transport layer. The undercoat layer containing an electron transport substance has a higher resistance than the undercoat layer that uses conductive ions or metal oxide fine particles and strongly reduces charge injection from the support side to the photosensitive layer side.

Japanese Patent Laid-Open No. 2010-145506 discloses an undercoat layer (electron transport layer) solely composed of a binder resin and a tetracarboxylic acid imide compound serving as an electron transport substance. The undercoat layer exhibits high mobility and significantly reduces charge injection. However, since the electron transport substance is solvent-soluble, the electron transport substance may leach out into a photosensitive layer or a coating liquid if a photosensitive layer is formed on the undercoat layer by coating, in particular, by dip-coating. As a result, the inherent electron transport ability is not fully exhibited and the electron transport ability has been insufficient in some cases. The electron transport substance leaching into the photosensitive layer (charge generation layer) degrades inherent electrophotographic properties of the photosensitive layer, such as chargeability, in some cases.

To address this issue, a technique of crosslinking the electron transport substance is available. Japanese Patent Laid-Open No. 2003-330209 discloses addition of a polymer of an electron transport substance having a non-hydrolyzable polymerizable functional group to an undercoat layer.

Crosslinking the electron transport substance reduces the occurrence of leaching. However, crosslinking inhibits sufficient withdrawal of electrons from the photosensitive layer (charge generation layer). Thus charge accumulation may occur and insufficient sensitivity may result.

SUMMARY OF THE INVENTION

An aspect of the present invention provides an electrophotographic photoconductor comprising a support, an undercoat layer, a charge generation layer, and a hole transport layer in this order. The undercoat layer comprises an electron transport substance, and the charge generation layer comprises a gallium phthalocyanine crystal and an amide compound represented by formula (N1):

Formula (N1)

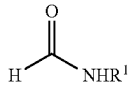

where $R^1$ represents a methyl group, a propyl group, or a vinyl group.

Another aspect of the present invention provides a process cartridge detachably attachable to a main body of an electrophotographic apparatus, comprising an electrophotographic photoconductor and at least one device selected from the group consisting of a charging device, a developing device, and a cleaning device. The electrophotographic photoconductor and the at least one device selected from the group consisting of a charging device, a developing device, and a cleaning device are integrally supported.

Another aspect of the present invention provides an electrophotographic apparatus comprising an electrophotographic photoconductor, a charging device, an exposing device, a developing device, and a transfer device.

Further features of the present invention will become apparent from the following description of exemplary embodiments with reference to the attached drawings.

DESCRIPTION OF THE EMBODIMENTS

Figure 1:
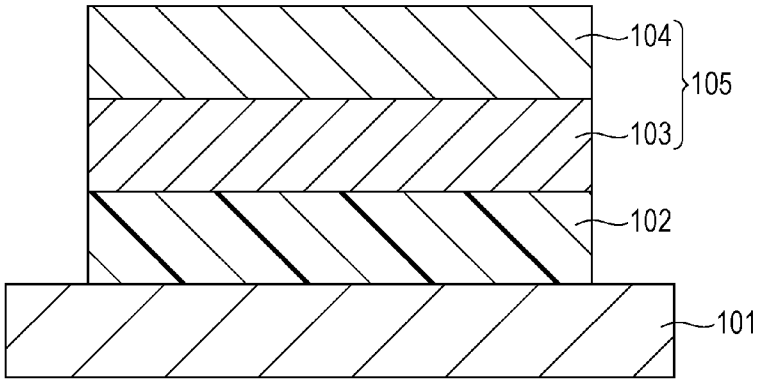
FIG. 1 is a diagram illustrating an example of a layer configuration of an electrophotographic photoconductor.

Presently, there is need to reduce ghosting in various environments as well as to maintain electrophotographic properties, such as chargeability and sensitivity, in long-term repeated use. In the case where a photosensitive layer (charge generation layer) is formed on an undercoat layer by coating, the electron transport substance in the undercoat layer leaches out and degrades electrophotographic properties, and charges accumulate at the interface between the photosensitive layer (charge generation layer) and the undercoat layer. It has been difficult to simultaneously address these two issues.

It is desirable to provide an electrophotographic photoconductor that has high levels of both chargeability and sensitivity and reduces ghosting even in a low-temperature low-humidity environment and in long-term repeated use. It is also desirable to provide a process cartridge and an electrophotographic apparatus that include the electrophotographic photoconductor.

Electrophotographic Photoconductor

As described above, an electrophotographic photoconductor according to an embodiment of the present invention includes a support, an undercoat layer on the support, a charge generation layer on the undercoat layer, and a hole transport layer on the charge generation layer. The undercoat layer contains an electron transport substance. The charge generation layer contains a gallium phthalocyanine crystal and an amide compound represented by formula (N1):

Formula (N1)

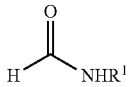

where $R^1$ represents a methyl group, a propyl group, or a vinyl group.

The electrophotographic photoconductor having the above-described features reduces ghosting and achieves both chargeability and sensitivity; the reason for this contemplated by the inventors of the present invention is as follows.

Electrons are withdrawn from inside the molecules of a gallium phthalocyanine crystal by a strong polarity of the compound represented by formula (N1) and an electron withdrawing property of the carbonyl group, and thus the flow of electrons from the gallium phthalocyanine crystal is improved. At the same time, the electron transport substance contained in the undercoat layer improves the flow of electrons in the undercoat layer.

Moreover, since the compound represented by formula (N1) and the electron transport substance co-exist near the interface between the charge generation layer and the undercoat layer, electrons flow from the gallium phthalocyanine crystal to the support without accumulation, and ghosting is thereby reduced. Furthermore, sufficient electron withdrawal occurs from the gallium phthalocyanine crystal to the electron transport substance or from the charge generation layer to the undercoat layer; thus, sensitivity is improved.

Since the compound represented by formula (N1) is located near the gallium phthalocyanine molecule, the energy level of the gallium phthalocyanine molecule changes. It is presumed that this change hinders leaching of the electron transport substance from the undercoat layer to the charge generation layer, formation of charge paths in the charge generation layer in an unexposed state, an increase in dark current, and degradation of chargeability.

The amount of the amide compound represented by formula (N1) is preferably 0.1% by mass or more and 3.0% by mass or less based on the total mass of the charge generation layer. When the amount of the amide compound represented by formula (N1) is within this range, an enhanced ghosting-reducing effect is obtained.

From the viewpoints of reducing ghosting and improving sensitivity, the amide compound represented by formula (N1) may be contained inside the gallium phthalocyanine crystal. When the amide compound represented by formula (N1) is contained inside the gallium phthalocyanine crystal, the gallium phthalocyanine crystal incorporates the amide compound represented by formula (N1).

The amount of the amide compound represented by formula (N1) contained inside the gallium phthalocyanine crystal may be 0.1% by mass or more and 3.0% by mass or less based on the amount of gallium phthalocyanine inside the gallium phthalocyanine crystal.

In formula (N1), $R^1$ may be a methyl group.

To achieve high image quality, the gallium phthalocyanine crystal may be a hydroxygallium phthalocyanine crystal that has a crystal form having peaks at Bragg angles 2θ of 7.4°±0.3° and 28.2°±0.3° in X-ray diffraction with a Cu Kα radiation.

The undercoat layer may contain a polymer of a composition that contains the electron transport substance and a crosslinking agent, in other words, may be an electron transport cured film.

An undercoat layer formed by polymerizing a crosslinking agent and an electron transport substance having a polymerizable functional group in order to reduce leaching tends to have lower sensitivity than an undercoat layer containing a resin and an electron transport substance (provided that occurrence of leaching is suppressed). A possible reason for this contemplated by the inventors is that electron injection from the gallium phthalocyanine crystal to the electron transport substance is decreased as a result of the undercoat layer taking a crosslinked structure of the electron transport substance.

In order to address this issue, as described above, the compound represented by formula (N1) and the electron transport substance are induced to co-exist near the interface between the charge generation layer and the undercoat layer so that the decrease in electron injection caused by the crosslinked structure is compensated. As a result, sufficient withdrawal of electrons from the charge generation layer to the undercoat layer occurs. Thus, leaching is reduced by the crosslinking structure, ghosting is reduced, and high levels of chargeability and sensitivity can be achieved.

The amount of the amount of the electron transport substance may be 30% by mass or more and 70% by mass or less based on the total mass of the undercoat layer. When the amount of the electron transport substance is within this range, reduction of ghosting and improvements on sensitivity can be achieved at higher levels.

When the amount of the electron transport substance based on the total mass of the undercoat layer is represented by PA (unit: % by mass) and the amount of the amide compound represented by formula (N1) based on the total mass of the charge generation layer is represented by PN (unit: % by mass), PN/PA may be 0.005 or more and 0.080 or less. When PN/PA is within the above-described range, a more appropriate relationship is established between the speed of electrons travelling from the gallium phthalocyanine crystal to the undercoat layer and the speed of electrons traveling within the undercoat layer. Thus, an electron transfer improving effect or an electron injection improving effect are enhanced.

As described above, the electrophotographic photoconductor of according to an embodiment of the present invention includes a support, an undercoat layer on the support, an charge generation layer on the undercoat layer, and a hole transport layer on the charge generation layer.

FIG. 1 is a diagram illustrating an example of a layer configuration of the electrophotographic photoconductor. Referring to FIG. 1, the electrophotographic photoconductor includes a support 101, an undercoat layer 102, an charge generation layer 103, a hole transport layer 104, and a photosensitive layer (multilayer-type photosensitive layer) 105.

Support

The support may have electrical conductivity, i.e., may be a conductive support. Examples thereof include a support made of metal (alloy) such as aluminum, iron, copper, gold, stainless steel, or nickel, and a support made of metal or an insulator having a surface coated with a conductive film. Examples of the support made of an insulator include plastic supports composed of polyester resin, polycarbonate resin, or polyimide resin, glass supports, and paper supports. Examples of the conductive film include metal thin films such as aluminum, chromium, silver, and gold thin films, conductive-material thin films such as indium oxide, tin oxide, and zinc oxide thin films, and thin films made of conductive inks containing silver nanowires.

Examples of the shape of the support include a cylindrical shape and a film shape. Among these, a cylindrical aluminum support exhibits excellent mechanical strength, electrophotographic properties, and cost efficiency. An elementary pipe may be directly used as a support. Alternatively, a surface of an elementary pipe may be subjected to a physical treatment such as cutting, honing, or blasting, an anodization treatment, or a chemical treatment using an acid or the like in order to improve electrical properties and reduce interference fringes, and this surface-treated pipe may be used as the support. A support obtained by performing a physical treatment, such as cutting, honing, or blasting, on an elementary pipe so that the pipe has a ten-point-average surface roughness Rzjis value specified in JIS B0601:2001 of 0.8 μm or more has an excellent interference-fringe-reducing function.

Conductive Layer

A conductive layer may be provided between the support and the undercoat layer, if needed. In particular, when an elementary pipe is directly used as the support, a conductive layer is formed on the support so that the interference-fringe-reducing function can be achieved by a simple procedure. This is particularly advantageous in terms of productivity and cost.

The conductive layer can be formed by coating the support with a coating liquid for forming a conductive layer and drying the resulting coating film. The coating liquid for forming a conductive layer can be prepared by dispersing conductive particles, a binder resin, and a solvent. Examples of the dispersing method include those methods that use a paint shaker, a sand mill, a ball mill, and a liquid-collision-type high-speed disperser. Examples of the conductive particles include carbon black, acetylene black, metal powder such as aluminum, nickel, iron, nichrome, copper, zinc, and silver powder, and metal oxide powder such as tin oxide particles, indium oxide particles, titanium oxide particles, and barium sulfate particles. Examples of the binder resin include polyester resin, polycarbonate resin, polyvinyl butyral resin, acrylic resin, silicone resin, epoxy resin, melamine resin, urethane resin, phenolic resin, and alkyd resin. Examples of the solvent include ether solvents such as tetrahydrofuran, dioxane, ethylene glycol monomethyl ether, and propylene glycol monomethyl ether, alcohol solvents such as methanol, ethanol, and isopropanol, ketone solvents such as acetone, methyl ethyl ketone, and cyclohexanone, ester solvents such as methyl acetate and ethyl acetate, and aromatic hydrocarbon solvents such as toluene and xylene. If needed, particles may be added to the coating liquid for forming a conductive layer in order to generate irregularities on the surface of the conductive layer.

The thickness of the conductive layer is preferably 5 to 40 μm and more preferably 10 to 30 μm from the viewpoints of the interference-fringe-reducing function and hiding (covering) of defects on the support, for example.

Undercoat Layer

An undercoat layer is formed on the support or the conductive layer.

The undercoat layer is an electron transport film that contains an electron transport substance and induces electrons to flow from the photosensitive layer side to the support side. Specifically, the following electron transport films may be used: a cured film obtained by curing an electron transport substance or a composition that contains an electron transport substance; a film formed by drying a coating film of a coating liquid for forming an electron transport film, the coating liquid containing an electron transport substance dissolved therein; and a film obtained by drying a coating film of a coating liquid for forming an electron transport film, the coating liquid containing an electron transport substance (for example, an electron transport pigment) dispersed therein.

Among these, a cured film may be used in order to further reduce leaching of the electron transport substance into the charge generation layer. The cured film is preferably obtained by curing a composition containing the electron transport substance and a crosslinking agent, and more preferably obtained by curing a composition containing the electron transport substance, a crosslinking agent, and a resin. For the cured film, the electron transport substance and the resin may be an electron transport substance having a polymerizable group and a resin having a polymerizable group, respectively. Examples of the polymerizable functional group include a hydroxy group, a thiol group, an amino group, a carboxyl group, and a methoxy group. A compound that can be polymerized or crosslinked with one or both of the electron transport substance having a polymerizable functional group and the resin having a polymerizable functional group can be used as the crosslinking agent.

The amount of the electron transport substance is 30% by mass or more and 70% by mass or less based on the total mass of the undercoat layer. When the amount of the electron transport substance is within this range, reduction of ghosting and improvements on sensitivity can be achieved at higher levels. When the electron transport substance having a polymerizable functional group is polymerized, the amount of the electron transport substance contained in the undercoat layer is calculated from the portion that contributes to electron transport and that excludes polymerizable function group moieties.

Electron Transport Substance

Examples of the electron transport substance include a quinone compound, an imide compound, a benzoimidazole compound, and a cyclopentadienylidene compound. The electron transport substance may be an electron transport substance having a polymerizable functional group. Examples of the polymerizable functional group include a hydroxy group, a thiol group, an amino group, a carboxyl group, and a methoxy group. Specific examples of the electron transport substance are compounds represented by formulae (A-1) to (A-11) below:

(A1)

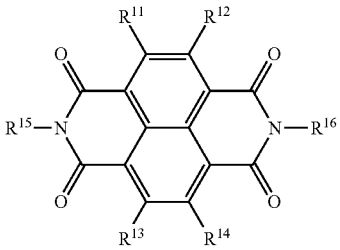

(A2)

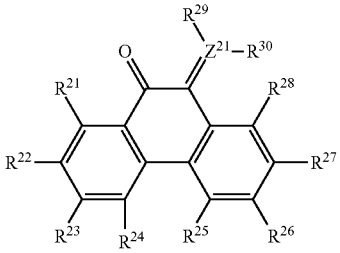

(A3)

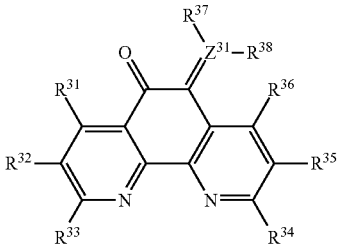

(A4)

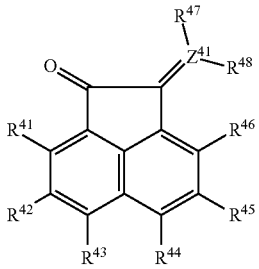

(A5)

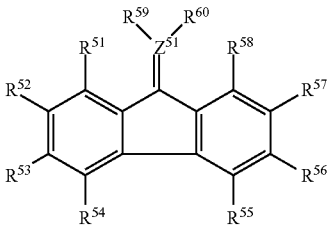

(A6)

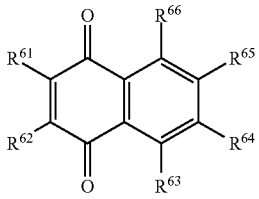

-continued (A7)

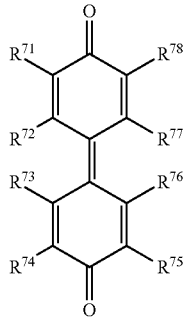

(A8)

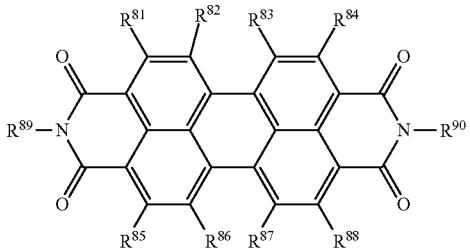

(A9)

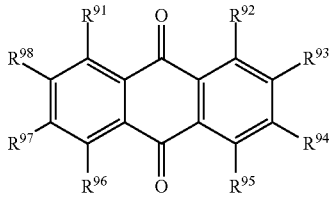

(A10)

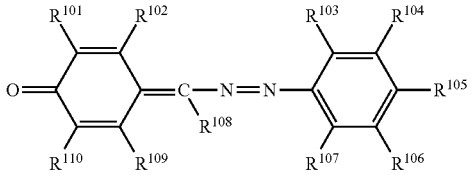

(A11)

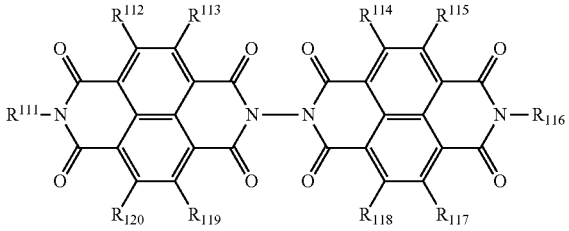

In formulae (A1) to (A11), $R^{11}$ to $R^{16}$, $R^{21}$ to $R^{30}$, $R^{31}$ to $R^{38}$, $R^{41}$ to $R^{48}$, $R^{51}$ to $R^{60}$, $R^{61}$ to $R^{66}$, $R^{71}$ to $R^{78}$, $R^{81}$ to $R^{90}$, $R^{91}$ to $R^{98}$, $R^{101}$ to $R^{110}$, and $R^{111}$ to $R^{120}$ each independently represent a monovalent group represented by formula (A) below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocycle. One carbon atom in the main chain of the alkyl group may be substituted with O, S, NH, or $NR^{1001}$ ($R^{1001}$ represents an alkyl group). Examples of the substituent for the substituted alkyl group include an alkyl group, an aryl group, a halogen atom, a carbonyl group, an alkoxy group, an alkoxycarbonyl group, and an alkenyl group. Examples of the substituent for the substituted aryl group and the substituent for the substituted heterocycle include a halogen atom, a nitro group, a cyano group, an alkyl group, a halogen-substituted alkyl group, a carbonyl group, an alkoxy group, an alkoxycarbonyl group, and an alkenyl group. $Z^{21}$, $Z^{31}$, $Z^{41}$, and $Z^{51}$ each independently represent a carbon atom, a nitrogen atom, or an oxygen atom. When $Z^{21}$ represents an oxygen atom, $R^{29}$ and $R^{30}$ are absent. When $Z^{21}$ represents a nitrogen atom, $R^{30}$ is absent. When $Z^{31}$ represents an oxygen atom, $R^{37}$ and $R^{38}$ are absent. When $Z^{31}$ represents a nitrogen atom, $R^{38}$ is absent. When $Z^{41}$ represents an oxygen atom, $R^{47}$ and $R^{48}$ are absent. When $Z^{41}$ represents a nitrogen atom, $R^{48}$ is absent. When $Z^{51}$ represents an oxygen atom, $R^{59}$ and $R^{60}$ are absent. When $Z^{51}$ represents a nitrogen atom, $R^{60}$ is absent.

$$-(\alpha)_l-(\beta)_m-\gamma \quad \text{(A)}$$

In formula (A), at least one selected from α, β, and γ represents a group having a substituent. The substituent is at least one group selected from the group consisting of a hydroxy group, a thiol group, an amino group, a carboxyl group, and a methoxy group. In the formula, l and m each independently represent 0 or 1, and the sum of l and m is 0 or more and 2 or less.

In the formula, α represents an alkylene group having a main chain having 1 to 6 carbon atoms, an alkylene group having a main chain having 1 to 6 carbon atoms and substituted with an alkyl group having 1 to 6 carbon atoms, an alkylene group having a main chain having 1 to 6 carbon atoms and substituted with a benzyl group, an alkylene group having a main chain having 1 to 6 carbon atoms and substituted with an alkoxycarbonyl group, or an alkylene group having a main chain having 1 to 6 carbon atoms and substituted with a phenyl group. These groups may each have at least one group selected from the group consisting of a hydroxy group, a thiol group, an amino group, and an carboxyl group as the substituent. One carbon atoms in the main chain of the alkylene group may be substituted with O, S, or $NR^{1002}$ (where $R^{1002}$ represents a hydrogen atom or an alkyl group).

In the formula, β represents a phenylene group, a phenylene group substituted with an alkyl group having 1 to 6 carbon atoms, a nitro-substituted phenylene group, a phenylene group substituted with a halogen group, or a phenylene group substituted with an alkoxy group. These groups may each have, as a substituent, at least one group selected the group consisting of a hydroxy group, a thiol group, an amino group, a carboxyl group, and a methoxy group.

In the formula, γ represents a hydrogen atom, an alkyl group having a main chain having 1 to 6 carbon atoms, or an alkyl group having a main chain having 1 to 6 carbon atoms and substituted with an alkyl group having 1 to 6 carbon atoms. These groups may each have, as a substituent, at least one group selected from the group consisting of a hydroxy group, a thiol group, an amino group, a carboxyl group, and a methoxy group. One carbon atom in the main chain of the alkyl group may be substituted with O, S, or $NR^{1003}$ (where $R^{1003}$ represents a hydrogen atom or an alkyl group).

The compounds represented by formulae (A1) to (A11) may each form an oligomer, a polymer, or a copolymer.

When the electron transport film is a cured film, at least one selected from $R^{11}$ to $R^{16}$, at least one selected from $R^{21}$ to $R^{30}$, at least one selected from $R^{31}$ to $R^{38}$, at least one selected from $R^{41}$ to $R^{48}$, at least one selected from $R^{51}$ to $R^{60}$, at least one selected from $R^{61}$ to $R^{66}$, at least one selected from $R^{71}$ to $R^{78}$, at least one selected from $R^{81}$ to $R^{90}$, at least one selected from $R^{91}$ to $R^{98}$, at least one selected from $R^{101}$ to $R^{110}$, and at least one selected from $R^{111}$ to $R^{120}$ may have a monovalent group represented by formula (A).

While specific examples of the electron transport substance having a polymerizable functional group are described in Tables 1-1 to 1-6, 2 to 6, 7-1, 7-2, and 8 to 11 below, the electron transport substance is not limited to these. In the tables, Aa and A each denote a monovalent group represented by formula (A). The columns headed by Aa and A indicate specific examples of the monovalent group represented by formula (A). When both A and Aa are present, different groups represented by formula (A) are present. In the tables, "–" in the γ column indicates a hydrogen atom, and the hydrogen atom of γ is included in the structure shown in the α or β column. A101 to A120 are specific examples of the compound represented by formula (A1). A201 to A206 are specific examples of the compound represented by formula (A2). A301 to A305 are specific examples of the compound represented by (A3). A401 to A405 are specific examples of the compound represented by formula (A4). A501 to A504 are specific examples of the compound represented by formula (A5). A601 to A605 are specific examples of the compound represented by formula (A6). A701 to A705 are specific examples of the compound represented by formula (A7). A801 to A805 are specific examples of the compound represented by formula (A8). A901 to A907 are specific examples of the compound represented by formula (A9). A1001 to A1005 are specific examples of the compound represented by formula (A10). A1101 to A1105 are specific examples of the compound represented by formula (A11).

TABLE 1-1

| | $R^{11}$ | $R^{12}$ | $R^{13}$ | $R^{14}$ | $R^{15}$ | $R^{16}$ |
|---|---|---|---|---|---|---|
| A101 | H | H | H | H | 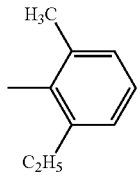 | A |
| A102 | H | H | H | H | 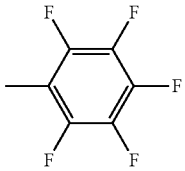 | A |
| A103 | H | H | H | H | 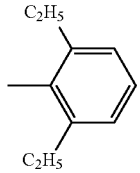 | A |
| A104 | H | H | H | H | 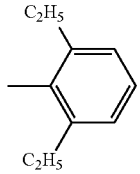 | A |

TABLE 1-1-continued
| | $R^{11}$ | $R^{12}$ | $R^{13}$ | $R^{14}$ | $R^{15}$ | $R^{16}$ |
|---|---|---|---|---|---|---|
| A105 | H | H | H | H | 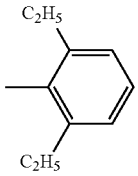 | A |
| A106 | H | H | H | H | A | A |
| A107 | H | H | H | H | A | A |
| A108 | H | H | H | H | 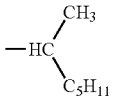 | A |
| A109 | H | H | H | H | 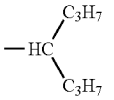 | A |
TABLE 1-2
| | A | | | Aa | | |
|---|---|---|---|---|---|---|
| | α | β | γ | α | β | γ |
| A101 | 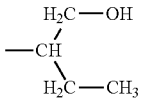 | — | — | — | — | — |
| A102 | 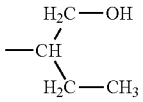 | — | — | — | — | — |
| A103 | — | 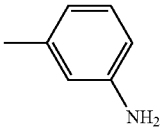 | — | — | — | — |
| A104 | — | 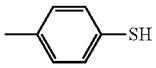 | — | — | — | — |
| A105 | 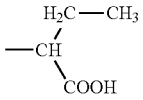 | — | — | — | — | — |
| A106 | 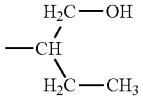 | — | — | — | — | — |
| A107 | 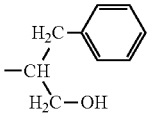 | — | — | — | — | — |
| A108 | 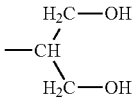 | — | — | — | — | — |
TABLE 1-2-continued
| | A | | | Aa | | |
|---|---|---|---|---|---|---|
| | α | β | γ | α | β | γ |
| A109 | 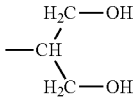 | — | — | — | — | — |
TABLE 1-3
| | $R^{11}$ | $R^{12}$ | $R^{13}$ | $R^{14}$ | $R^{15}$ | $R^{16}$ |
|---|---|---|---|---|---|---|
| A110 | H | H | H | H | 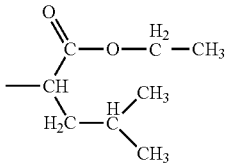 | A |
| A111 | H | H | H | H | 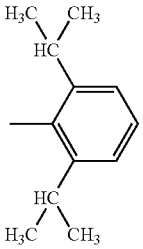 | A |
| A112 | H | H | H | H | 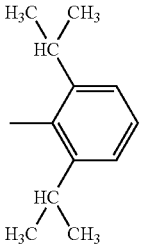 | A |
| A113 | H | H | H | H | A | A |
| A114 | H | H | H | H | A | A |
| A115 | H | H | H | H | A | Aa |
| A116 | H | H | H | H | A | Aa |
| A117 | H | H | H | H | A | Aa |

TABLE 1-4
| | A | | | Aa | | |
|---|---|---|---|---|---|---|
| | α | β | γ | α | β | γ |
| A110 | 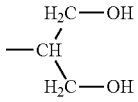 | — | — | — | — | — |
| A111 | 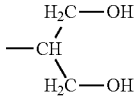 | — | — | — | — | — |
| A112 | 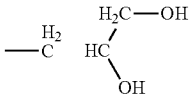 | — | — | — | — | — |
| A113 | 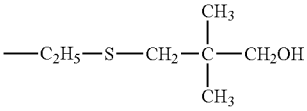 | — | — | — | — | — |
| A114 | 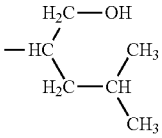 | — | — | — | — | — |
| A115 | $—C_2H_4—S—C_2H_4—OH$ | — | — | 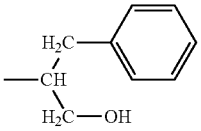 | — | — |
| A116 | — | 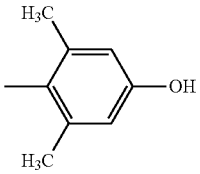 | — | 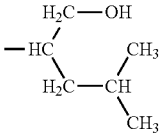 | — | — |
| A117 | — | 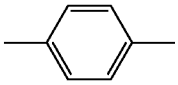 | $—CH_2—OH$ | 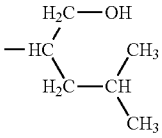 | — | — |
50
TABLE 1-5
| | $R^{11}$ | $R^{12}$ | $R^{13}$ | $R^{14}$ | $R^{15}$ | $R^{16}$ |
|---|---|---|---|---|---|---|
| A118 | H | H | H | H | A | Aa |
| A119 | H | H | H | H | A | Aa |
| A120 | H | H | H | H | A | A |
| A121 | H | H | H | H | 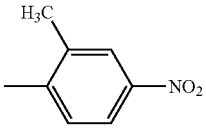 | 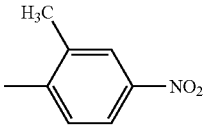 |

TABLE 1-5-continued
| | $R^{11}$ | $R^{12}$ | $R^{13}$ | $R^{14}$ | $R^{15}$ | $R^{16}$ |
|---|---|---|---|---|---|---|
| A122 | H | H | H | H | 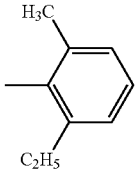 | 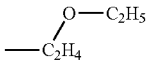 |
| A123 | H | H | H | H | 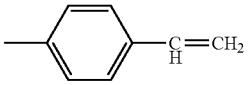 | $—C_5H_{11}$ |
| A124 | H | H | H | H | 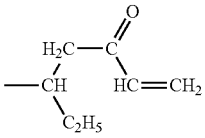 | 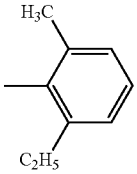 |
| A125 | H | H | H | H | 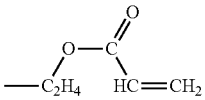 | 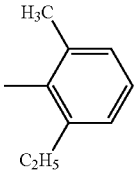 |
TABLE 1-6
| | A | | | Aa | | |
|---|---|---|---|---|---|---|
| | α | β | γ | α | β | γ |
| A118 | — | 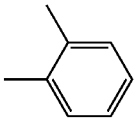 | $—CH_2—OH$ | 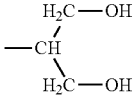 | — | — |
| A119 | 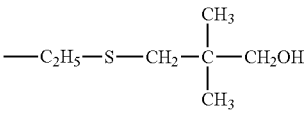 | — | — | 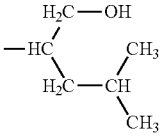 | — | — |
| A120 | 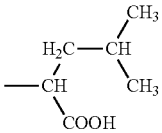 | — | — | — | — | — |
| A121 | — | — | — | — | — | — |
| A122 | — | — | — | — | — | — |
| A123 | — | — | — | — | — | — |
| A124 | — | — | — | — | — | — |
| A125 | — | — | — | — | — | — |

TABLE 2

| Example Compound | $R^{21}$ | $R^{22}$ | $R^{23}$ | $R^{24}$ | $R^{25}$ | $R^{26}$ | $R^{27}$ | $R^{28}$ | $R^{29}$ | $R^{30}$ | $R^{31}$ | A α | A β | A γ |
|---|---|---|---|---|---|---|---|---|---|---|---|---|---|---|
| A201 | H | H | A | H | H | H | H | H | — | — | O | — | 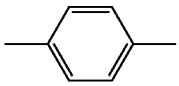 | —$CH_2$—OH |
| A202 | H | H | H | H | H | H | H | H | A | — | N | — | 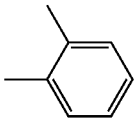 | $H_2C$—OH / —$CH_2$ |
| A203 | H | H | 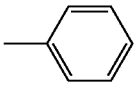 | H | H | 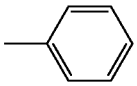 | H | H | A | — | N | — | 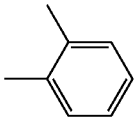 | $H_2C$—OH / —$CH_2$ |
| A204 | H | H | 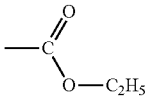 | H | H | 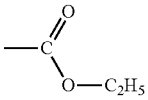 | H | H | A | — | N | — | 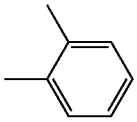 | $H_2C$—OH / —$CH_2$ |
| A205 | H | H | A | H | H | A | H | H | — | — | O | — | 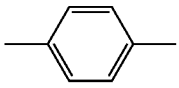 | —$CH_2$—OH |
| A206 | H | A | H | H | H | H | A | H | — | — | O | — | 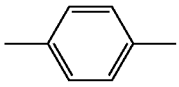 | —$CH_2$—OH |
| A207 | H | H | 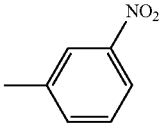 | H | H | 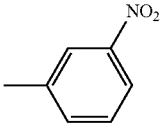 | H | H | — | — | O | — | — | — |

TABLE 3

| Example Compound | $R^{31}$ | $R^{32}$ | $R^{33}$ | $R^{34}$ | $R^{35}$ | $R^{36}$ | $R^{37}$ | $R^{38}$ | $Z^{31}$ | A α | A β | A γ |
|---|---|---|---|---|---|---|---|---|---|---|---|---|
| A301 | H | A | H | H | H | H | — | — | O | — | 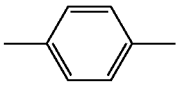 | —$CH_2$—OH |
| A302 | H | H | H | H | H | H | A | — | N | — | 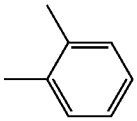 | $H_2C$—OH / —$CH_2$ |
| A303 | H | H | H | H | H | H | A | — | N | $H_2C$—OH / —CH \ $H_2C$—$CH_3$ | — | — |

TABLE 3-continued

| Example Compound | $R^{31}$ | $R^{32}$ | $R^{33}$ | $R^{34}$ | $R^{35}$ | $R^{36}$ | $R^{37}$ | $R^{38}$ | $Z^{31}$ | A α | A β | A γ |
|---|---|---|---|---|---|---|---|---|---|---|---|---|
| A304 | H | H | Cl | Cl | H | H | A | — | N | — | 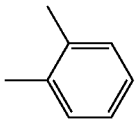 | $H_2C$—OH / —$CH_2$ |
| A305 | H | A | H | H | A | H | CN | CN | C | — | 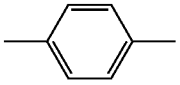 | —$CH_2$—OH |

TABLE 4

| Example Compound | $R^{41}$ | $R^{42}$ | $R^{44}$ | $R^{44}$ | $R^{45}$ | $R^{46}$ | $R^{47}$ | $R^{48}$ | $Z^{41}$ | A α | A β | A γ |
|---|---|---|---|---|---|---|---|---|---|---|---|---|
| A401 | H | H | A | H | H | H | CN | CN | C | — | 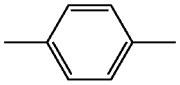 | —$CH_2$—OH |
| A402 | H | H | H | H | H | H | A | — | N | — | 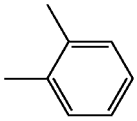 | $H_2C$—OH / —$CH_2$ |
| A403 | H | H | A | A | H | H | CN | CN | C | — | 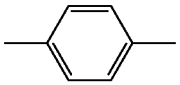 | —$CH_2$—OH |
| A404 | H | H | A | A | H | H | CN | CN | C | — | 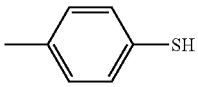 | — |
| A405 | H | H | A | A | H | H | — | — | O | — | 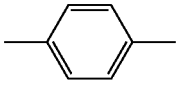 | —$CH_2$—OH |
| A406 | H | H | 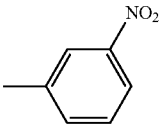 | H | H | H | CN | CN | C | — | — | — |

TABLE 5

| Example Compound | $R^{51}$ | $R^{52}$ | $R^{53}$ | $R^{54}$ | $R^{55}$ | $R^{56}$ | $R^{57}$ | $R^{58}$ | $R^{59}$ | $R^{60}$ | $Z^{51}$ | A α | A β | A γ |
|---|---|---|---|---|---|---|---|---|---|---|---|---|---|---|
| A501 | H | A | H | H | H | H | H | H | CN | CN | C | — | 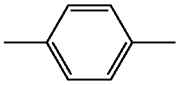 | —$CH_2$—OH |

TABLE 5-continued

| Example Compound | $R^{51}$ | $R^{52}$ | $R^{53}$ | $R^{54}$ | $R^{55}$ | $R^{56}$ | $R^{57}$ | $R^{58}$ | $R^{59}$ | $R^{60}$ | $Z^{51}$ | A α | A β | A γ |
|---|---|---|---|---|---|---|---|---|---|---|---|---|---|---|
| A502 | H | $NO_2$ | H | H | $NO_2$ | H | $NO_2$ | H | A | — | N | — | 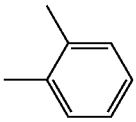 | $H_2C—OH$ / $—CH_2$ |
| A503 | H | A | H | H | H | H | A | H | CN | CN | C | $H_2C—OH$ / —CH \ $H_2C—CH_3$ | 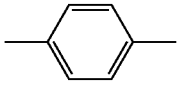 | — |
| A504 | H | H | A | H | H | A | H | H | CN | CN | C | — | | $—CH_2—OH$ |

TABLE 6

| Example Compound | $R^{61}$ | $R^{62}$ | $R^{63}$ | $R^{64}$ | $R^{65}$ | $R^{66}$ | A α | A β | A γ |
|---|---|---|---|---|---|---|---|---|---|
| A601 | A | H | H | H | H | H | — | 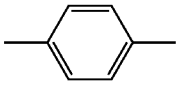 | $—CH_2—OH$ |
| A602 | A | H | H | H | H | H | — | 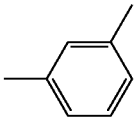 | $—CH_2—OH$ |
| A603 | A | H | H | H | H | H | $H_2C—OH$ / —CH \ $H_2C—CH_3$ | — | — |
| A604 | A | A | H | H | H | H | — | 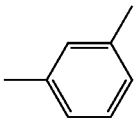 | $—CH_2—OH$ |
| A605 | A | A | H | H | H | H | $H_2C—OH$ / —CH \ $H_2C—CH_3$ | — | — |
| A606 | $—NO_2$ | —CN | H | H | H | H | — | — | — |
| A607 | —C(=O)—$HC=CH_2$ | H | H | H | H | H | — | — | — |

TABLE 7-1

| Example Compound | $R^{71}$ | $R^{72}$ | $R^{73}$ | $R^{74}$ | $R^{75}$ | $R^{76}$ | $R^{77}$ | $R^{78}$ |
|---|---|---|---|---|---|---|---|---|
| A701 | A | H | H | H | H | H | H | H |
| A702 | A | H | H | H | H | H | H | H |
| A703 | A | H | H | H | A | H | H | H |

TABLE 7-1-continued
| Example Compound | $R^{71}$ | $R^{72}$ | $R^{73}$ | $R^{74}$ | $R^{75}$ | $R^{76}$ | $R^{77}$ | $R^{78}$ |
|---|---|---|---|---|---|---|---|---|
| A704 | A | H | H | H | Aa | H | H | H |
| A705 | A | H | H | H | Aa | H | H | H |
| A706 | $-C(CH_3)_2-CH_3$ | H | H | $-C(CH_3)_2-CH_3$ | $-C(CH_3)_2-CH_3$ | H | H | $-C(CH_3)_2-CH_3$ |
TABLE 7-2
| Example | A | | | Aa | | |
|---|---|---|---|---|---|---|
| Compound | α | β | γ | α | β | γ |
| A701 | — | 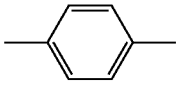 | $-CH_2-OH$ | — | — | — |
| A702 | $-CH(H_2C-OH)(H_2C-CH_3)$ | — | — | — | — | — |
| A703 | — | 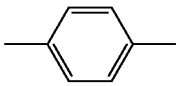 | $-CH_2-OH$ | — | — | — |
| A704 | $-CH(H_2C-OH)(H_2C-CH_3)$ | — | — | — | 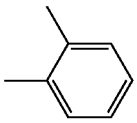 | $-CH_2-OH$ |
| A705 | 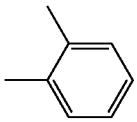 | 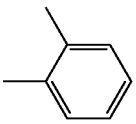 | $-CH_2-OH$ | $-(CH_2)_5-OH$ | 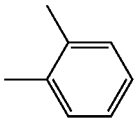 | 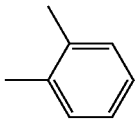 |
| A706 | — | — | — | — | — | — |
TABLE 8
| Example Compound | $R^{81}$ | $R^{82}$ | $R^{83}$ | $R^{84}$ | $R^{85}$ | $R^{86}$ | $R^{87}$ | $R^{88}$ | $R^{89}$ | $R^{90}$ | A α | A β | A γ |
|---|---|---|---|---|---|---|---|---|---|---|---|---|---|
| A801 | H | H | H | H | H | H | H | H | 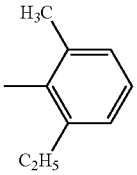 | A | $-CH(H_2C-OH)(H_2C-CH_3)$ | — | — |

TABLE 8-continued
| Example Compound | $R^{81}$ | $R^{82}$ | $R^{83}$ | $R^{84}$ | $R^{85}$ | $R^{86}$ | $R^{87}$ | $R^{88}$ | $R^{89}$ | $R^{90}$ | A α | A β | A γ |
|---|---|---|---|---|---|---|---|---|---|---|---|---|---|
| A802 | H | H | H | H | H | H | H | H | 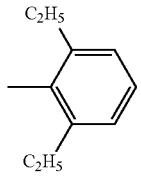 | A | — | 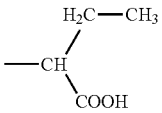 | — |
| A803 | H | CN | H | H | H | H | CN | H | 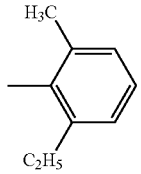 | A | 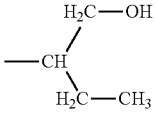 | — | — |
| A804 | H | H | H | H | H | H | H | H | A | A | 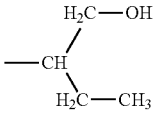 | — | — |
| A805 | H | H | H | H | H | H | H | H | A | A | — | 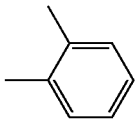 | 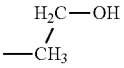 |
| A806 | H | H | H | H | H | H | H | H | 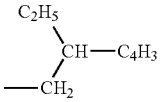 | 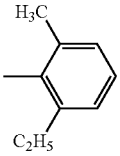 | — | — | — |
| A807 | H | H | H | H | H | H | H | H | 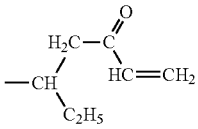 | 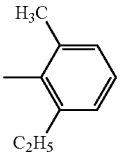 | — | — | — |
TABLE 9
| Example Compound | $R^{91}$ | $R^{92}$ | $R^{93}$ | $R^{94}$ | $R^{95}$ | $R^{96}$ | $R^{97}$ | $R^{98}$ | A α | A β | A γ |
|---|---|---|---|---|---|---|---|---|---|---|---|
| A901 | A | H | H | H | H | H | H | H | $—CH_2—OH$ | — | — |
| A902 | A | H | H | H | H | H | H | H | $—(CH_2)_2—OH$ | — | — |
| A903 | H | H | H | H | H | H | H | A | $—CH_2—OH$ | — | — |
| A904 | H | H | H | H | H | H | H | A | $—(CH_2)_2—OH$ | — | — |

TABLE 9-continued

| Example Compound | $R^{91}$ | $R^{92}$ | $R^{93}$ | $R^{94}$ | $R^{95}$ | $R^{96}$ | $R^{97}$ | $R^{98}$ | A α | A β | A γ |
|---|---|---|---|---|---|---|---|---|---|---|---|
| A905 | H | CN | H | H | H | H | CN | A | — | 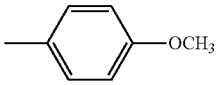 | — |
| A906 | A | A | H | $NO_2$ | H | H | $NO_2$ | H | $-(CH_2)_2-OH$ | — | — |
| A907 | H | A | A | H | H | H | H | H | $-CH_2-OH$ | — | — |

TABLE 10

| Example Compound | $R^{101}$ | $R^{102}$ | $R^{103}$ | $R^{104}$ | $R^{105}$ | $R^{106}$ | $R^{107}$ | $R^{108}$ | $R^{109}$ | $R^{110}$ | A α | A β | A γ |
|---|---|---|---|---|---|---|---|---|---|---|---|---|---|
| A1001 | 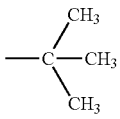 | H | H | H | A | H | H | H | H | 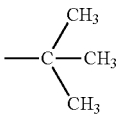 | $-CH_2-OH$ | — | — |
| A1002 | 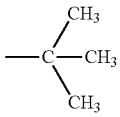 | H | H | H | A | H | H | H | H | 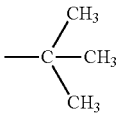 | — | 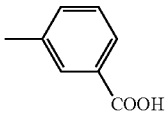 | — |
| A1003 | 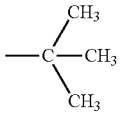 | H | H | H | A | H | H | H | H | 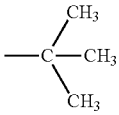 | — | 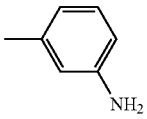 | — |
| A1004 | 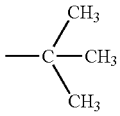 | H | H | H | A | H | H | H | H | 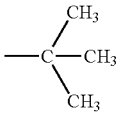 | — | 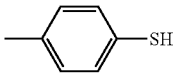 | — |
| A1005 | 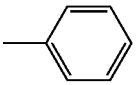 | H | H | H | A | H | H | H | H | 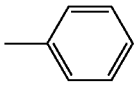 | $-CH_2-OH$ | — | — |

TABLE 11

| Example Compound | $R^{111}$ | $R^{112}$ | $R^{113}$ | $R^{114}$ | $R^{115}$ | $R^{116}$ | $R^{117}$ | $R^{118}$ | $R^{119}$ | $R^{120}$ | A α | A β | A γ |
|---|---|---|---|---|---|---|---|---|---|---|---|---|---|
| A1101 | A | H | H | H | H | A | H | H | H | H | 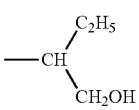 | — | — |

TABLE 11-continued

| Example Compound | $R^{111}$ | $R^{112}$ | $R^{113}$ | $R^{114}$ | $R^{115}$ | $R^{116}$ | $R^{117}$ | $R^{118}$ | $R^{119}$ | $R^{120}$ | A α | A β | A γ |
|---|---|---|---|---|---|---|---|---|---|---|---|---|---|
| A1102 | A | H | H | H | H | A | H | H | H | H | 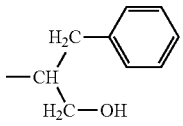 | — | — |
| A1103 | A | H | H | H | H | A | H | H | H | H | — | 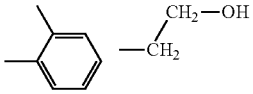 | |
| A1104 | A | H | H | H | H | 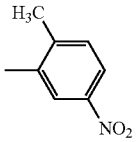 | H | H | H | H | 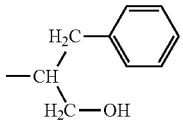 | — | — |
| A1105 | A | H | H | H | H | 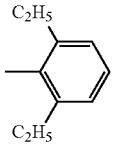 | H | H | H | H | 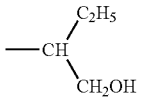 | — | — |

Derivatives (derivatives of electron transport substances) having any one of the structures represented by (A2) to (A6) and (A9) are commercially available from Tokyo Chemical Industry, Co., Ltd., Sigma-Aldrich Japan Co., or Johnson Matthey Japan Incorporated. A derivative having the structure represented by (A1) can be synthesized by reaction of a monoamine derivative and a naphthalene tetracarboxylic dianhydride commercially available from Tokyo Chemical Industry Co., Ltd., or Johnson Matthey Japan Incorporated. A derivative having the structure represented by (A7) can be synthesized by using as a raw material a phenolic derivative commercially available from Tokyo Chemical Industry Co., Ltd., or Sigma-Aldrich Japan Co. A derivative having the structure represented by (A8) can be synthesized by a reaction of a monoamine derivative and a perylene tetracarboxylic dianhydride commercially available from Tokyo Chemical Industry Co., Ltd., or Sigma-Aldrich Japan Co. A derivative having the structure represented by (A10) can be synthesized by oxidizing a phenolic derivative having a hydrazone structure with an appropriate oxidant such as potassium permanganate in an organic solvent through a known synthetic method described in, for example, Japanese Patent No. 3717320. A derivative having the structure represented by (A11) can be synthesized by a reaction of a naphthalene tetracarboxylic dianhydride, a monoamine derivative, and hydrazine commercially available from Tokyo Chemical Industry Co., Ltd., Sigma-Aldrich Japan Co., or Johnson Matthey Japan Incorporated.

Some of the compounds represented by (A1) to (A11) have a polymerizable group (a hydroxy group, a thiol group, an amino group, a carboxyl group, or a methoxy group) polymerizable with a crosslinking agent. The following methods are available as the method for synthesizing a compound represented by any one of (A1) to (A11) by introducing a polymerizable functional group into a derivative having a structure represented by any one of (A1) to (A11).

For example, a method including synthesizing a derivative having a structure represented by any one of (A1) to (A11) and then directly introducing a polymerizable functional group into the derivative is available. A method including introducing a structure that has a polymerizable functional group or a functional group that can serve as a precursor of a polymerizable functional group is also available. An example of the latter method is a method that includes performing a cross-coupling reaction of a halide of a derivative having a structure represented by any one of (A1) to (A11) in the presence of, for example, a palladium catalyst and a base so as to introduce an aryl group having a functional group. Another example is a method that includes performing a cross-coupling reaction of a halide of a derivative having a structure represented by any one of (A1) to (A11) in the presence of an FeCl3 catalyst and a base so as to introduce an alkyl group having a functional group. Yet another example is a method that includes lithiating a halide of a derivative having a structure represented by any one of (A1) to (A11), and inducing the resultant product to react with an epoxy compound or $CO_2$ so as to introduce a hydroxyalkyl group or a carboxyl group.

The electron transport substance having a polymerizable functional group may have two or more polymerizable functional groups in the same molecule in order to increase the solvent resistance and form a strong crosslinked structure.

Crosslinking Agent

The crosslinking agent is described next.

Compounds commonly used as crosslinking agents can be used as the crosslinking agent. Specifically, compounds described in "Kakyo-zai Handobukku [Handbook of Crosslinking Agents]" edited by Shinzo YAMASHITA and Tosuke KANEKO, published by Taiseisha Ltd. (1981), etc., can be used.

The crosslinking agent may have a functional group for polymerizing or crosslinking one or both of the electron transport substance having a polymerizable group and the resin having a polymerizable functional group.

When the undercoat layer is an electron transport cured film obtained by polymerizing a composition that contains an electron transport substance, a crosslinking agent, and a resin, the crosslinking agent may have 3 to 6 polymerizable functional groups. When 3 to 6 polymerizable functional groups are present, aggregation (localization) of resin molecular chains is reduced during polymerization of the electron transport substance, the crosslinking agent, and the resin. Moreover, since the electron transport substance is bonded to the crosslinking agent bonded to the molecular chains of the resin with reduced localization, the electron transport substance also exist evenly in the undercoat layer without being localized. Possibly as a result, an even three-dimensional structure derived from the electron transport substance, the crosslinking agent, and the resin is obtained, accumulation of electrons in the undercoat layer is significantly reduced, and a higher level of ghosting reducing effect is obtained. At the same time, it is believed since the electron transport substance near the interface between the charge generation layer and the undercoat layer is evenly distributed, sufficient electron withdrawal from the charge generation layer to the undercoat layer occurs, and the sensitivity is thereby improved.

The crosslinking agent used in the present invention may be an isocyanate compound or an amino compound.

The isocyanate compound used in the present invention may contain 3 to 6 isocyanate groups or blocked isocyanate groups. Examples thereof include benzene triisocyanate, methylbenzene triisocyanate, triphenylmethane triisocyanate, and lysine triisocyanate, and various modified compounds such as isocyanurate-modified compounds, Biuret-modified compounds, allophanate-modified compounds, and trimethylolpropane or pentaerythritol-adduct-modified compounds of diisocyanates such as tolylene diisocyanate, hexamethylene diisocyanate, dicyclohexylmethane diisocyanate, naphthalene diisocyanate, diphenylmethane diisocyanate, isophorone diisocyanate, xylene diisocyanate, 2,2,4-trimethylhexamethylene diisocyanate, methyl-2,6-diisocyanate hexanoate, and norbornane diisocyanate.

Among these, isocyanate-modified compounds and the adduct-modified compounds are suitable for use.

The blocked isocyanate group takes the form of —NHCOX (X represents a protective group). X may be any protective group that can be introduced into an isocyanate group and may be any one of groups represented by (H1) to (H6) below.

(H1)

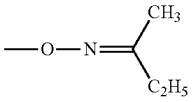

(H2)

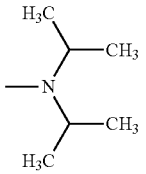

-continued (H3)

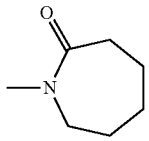

(H4)

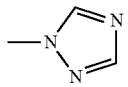

(H5)

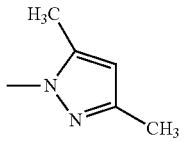

(H6)

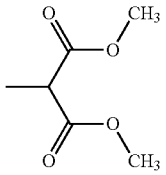

Specific examples of the isocyanate compounds are described in Tables 12-1 to 12-3 below.

TABLE 12-1

B1

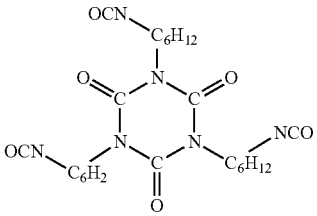

B2

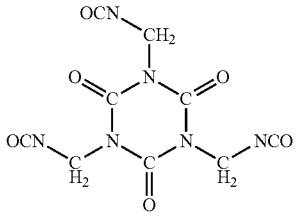

B3

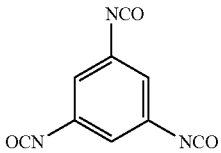

TABLE 12-1-continued
B4
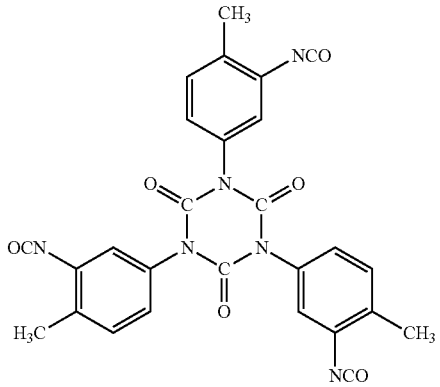
B5
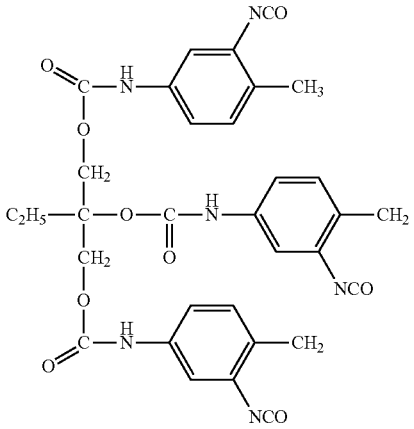
TABLE 12-1-continued
B6
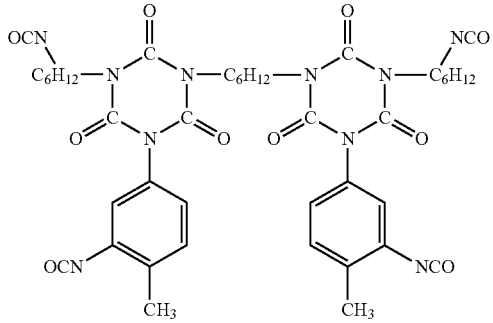
B7
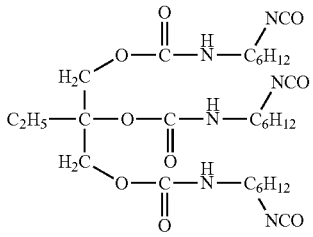
B8
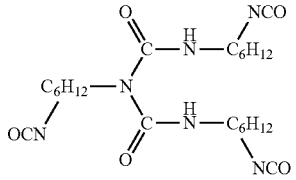
TABLE 12-2
B9
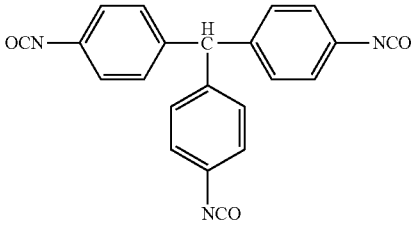
B10
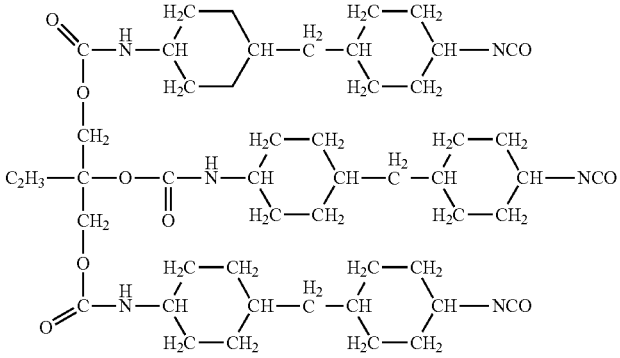

TABLE 12-2-continued
B11
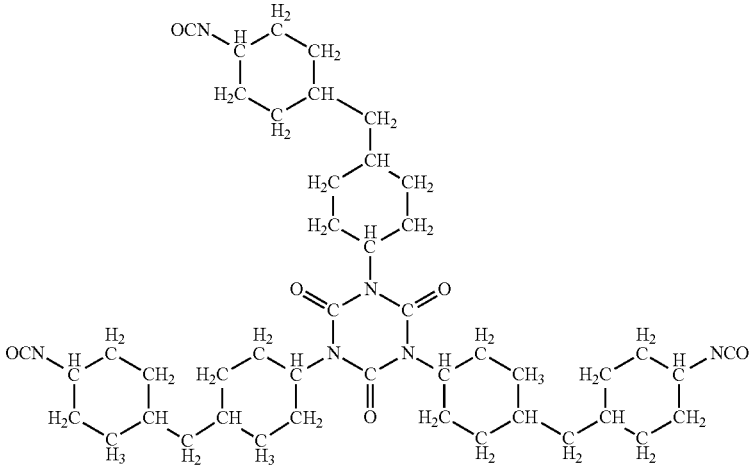
B12
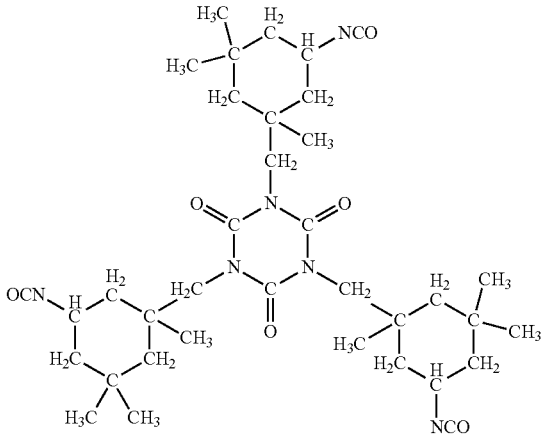
B13
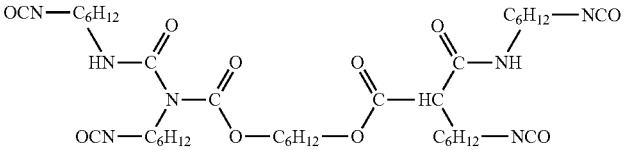
B14
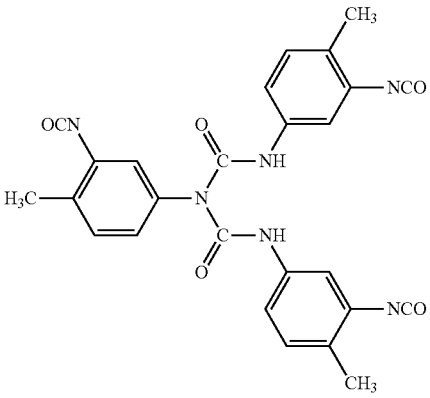
B15
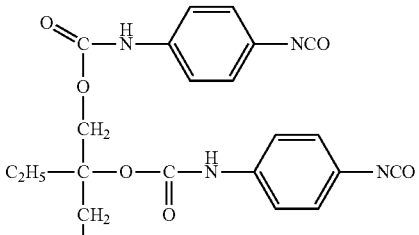

TABLE 12-3
B17
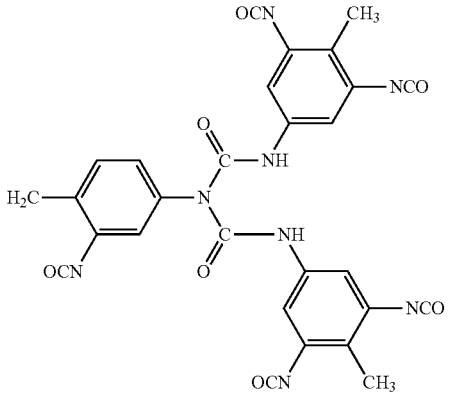
B18
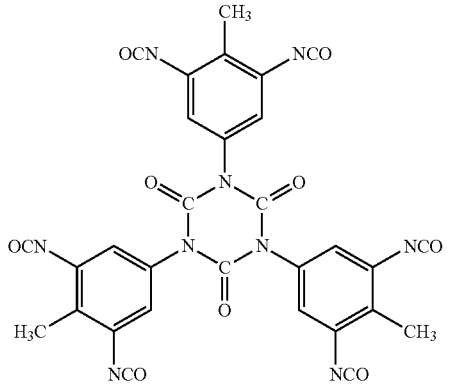
B19
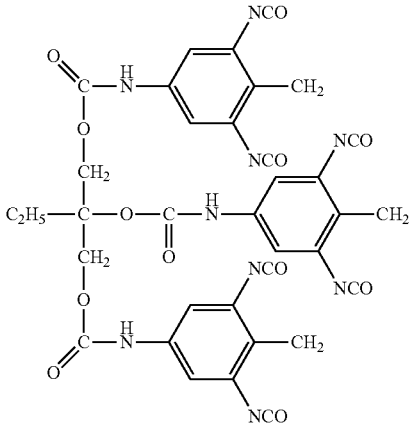
B20
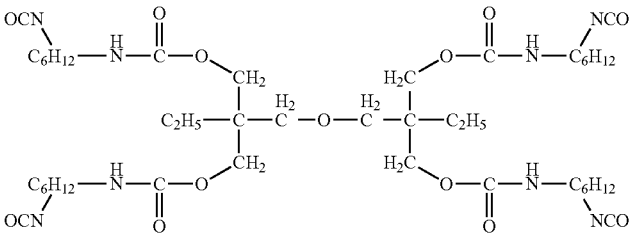

TABLE 12-3-continued

B21

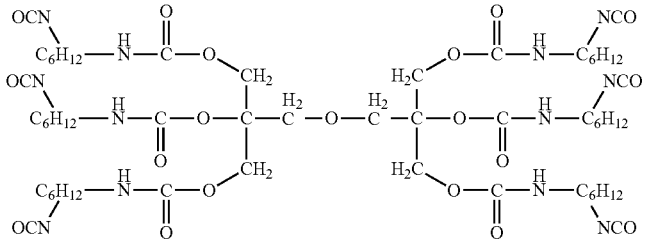

Examples of the amino compound used in the present invention are compounds represented by formulae (C1) to (C5) below. The amino compound may have a molecular weight in the range of 200 to 1000 in order to form a more even cured film.

(C1)

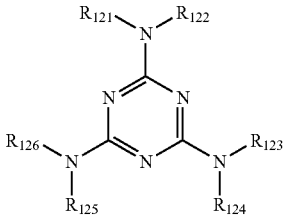

(C2)

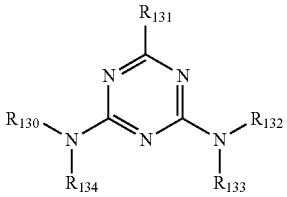

(C3)

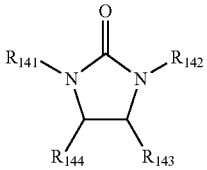

(C4)

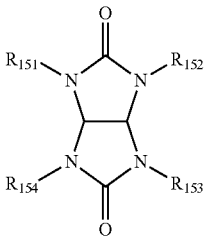

(C5)

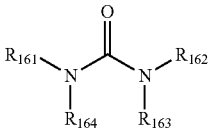

In formulae (C1) to (C5), $R^{121}$ to $R^{126}$, $R^{131}$ to $R^{135}$, $R^{141}$ to $R^{144}$, $R^{151}$ to $R^{154}$, and $R^{161}$ to $R^{164}$ each independently represent a hydrogen atom, —$CH_2$, —OH, or —$CH_2$—O—$R^{1004}$ where $R^{1004}$ represents a branched or unbranched alkyl group having 1 to 10 carbon atoms. The alkyl group may be a methyl group, an ethyl group, a butyl group, or the like, from the viewpoint of polymerizability.

Specific examples of the compounds represented by general formulae (C1) to (C5) include, but are not limited to, those described below. Moreover, although the specific examples described below are monomers, oligomers that contain these monomers as constitutional units may also be contained. In the present invention, 10% by mass or more of the monomer described above may be contained in the compound represented by any one of general formulae (C1) to (C5) since aggregations of the resin chains is reduced and an even three-dimensional polymer film is obtained.

The degree of polymerization of the oligomer is preferably 2 or more and 100 or less. Two or more oligomers and monomers may be mixed and used. Examples of commercially available products of the compound represented by general formula (C1) include, but are not limited to, SUPER MELAMI No. 90 (produced by NOF Corporation), SUPER BECKAMINE® TD-139-60, L-105-60, L127-60, L110-60, J-820-60, and G-821-60 (produced by DIC Corporation), U-VAN 2020 (produced by Mitsui Chemicals Inc.), SUMITEX RESIN M-3 (produced by Sumitomo Chemical Co., Ltd.), and NIKALAC MW-30, MW-390, and MX-750LM (produced by Nippon Carbide Industries, Co., Inc.). Examples of the commercially available products of the compound represented by general formula (C2) include SUPER MECKAMINE® L-148-55, 13-535, L-145-60, and TD-126 (produced by DIC Corporation) and NIKALAC BL-60 and BX-4000 (produced by Nippon Carbide Industries, Co., Inc.). Examples of the commercially available products of the compound represented by general formula (C3) include NIKALAC MX-280 (produced by Nippon Carbide Industries, Co., Inc.). Examples of the commercially available products of the compound represented by general formula (C4) include NIKALAC MX-270 (produced by Nippon Carbide Industries, Co., Inc.). Examples of the commercially available products of the compound represented by general formula (C5) include NIKALAC MX-290 (produced by Nippon Carbide Industries, Co., Inc.).

Specific examples of the compound represented by formula (C1) are described in Table 13 below.

TABLE 13

C1-1

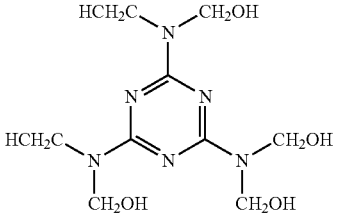

TABLE 13-continued
C1-2
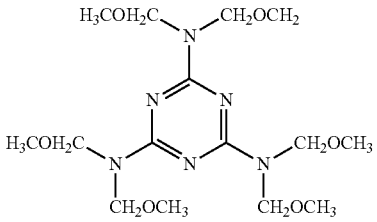
C1-3
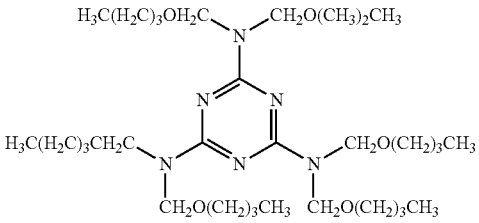
C1-4
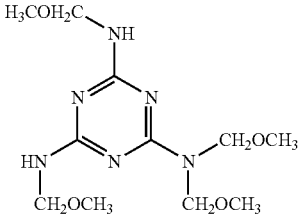
C1-5
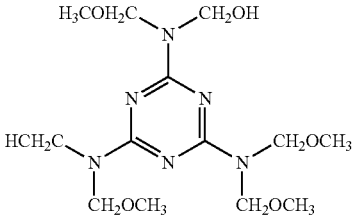
C1-6
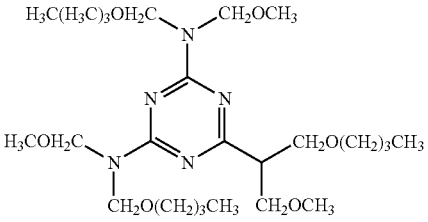
C1-7
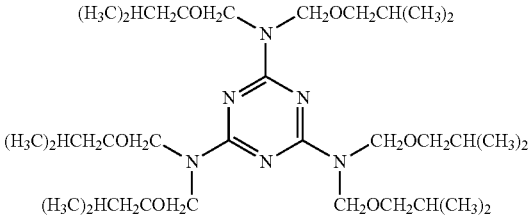
C1-8
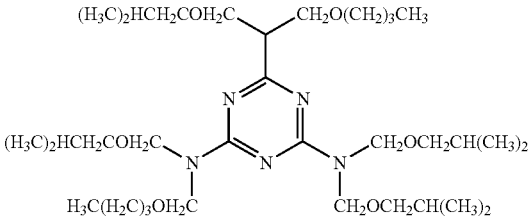
TABLE 13-continued
C1-9
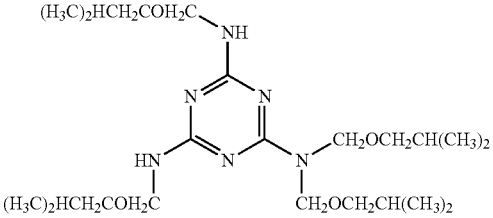
C1-10
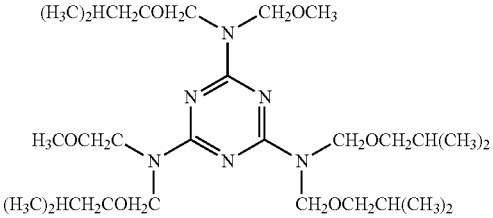
C1-11
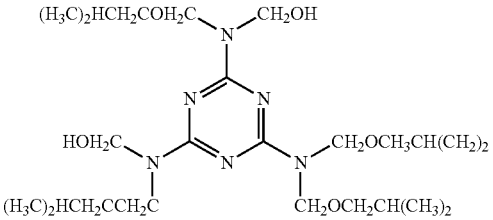
C1-12
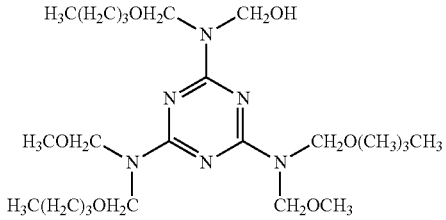
Specific examples of the compound represented by formula (C2) are described in Tables 14-1 and 14-2 below.
TABLE 14-1
C2-1
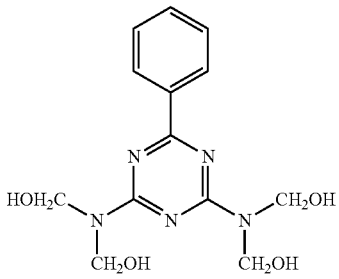
C2-2
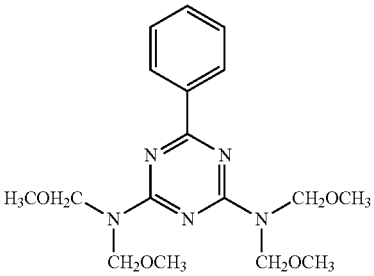

TABLE 14-1-continued
C2-3
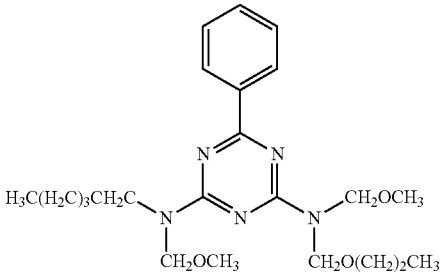
C2-4
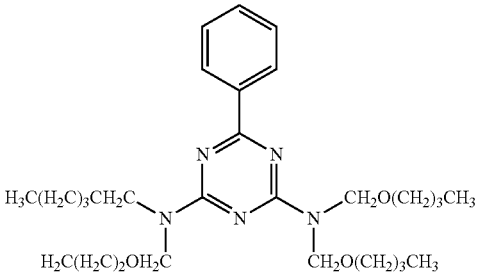
C2-5
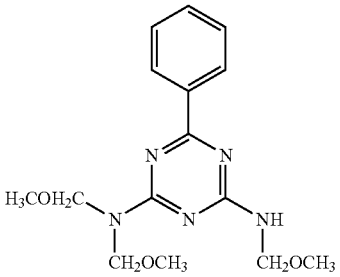
C2-6
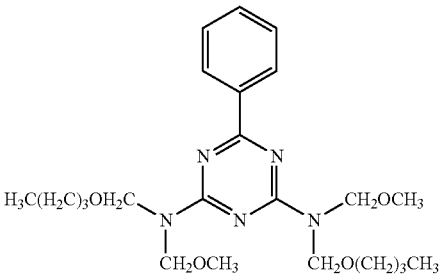
C2-7
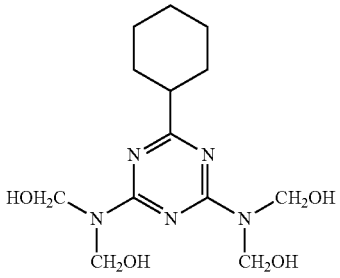
TABLE 14-1-continued
C2-8
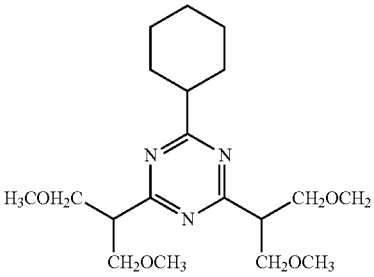
C2-9
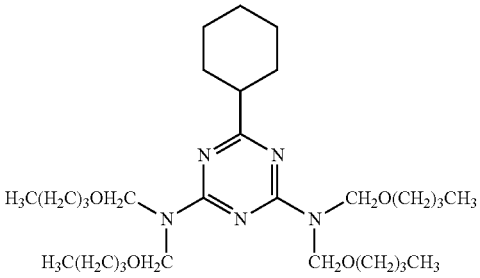
C2-10
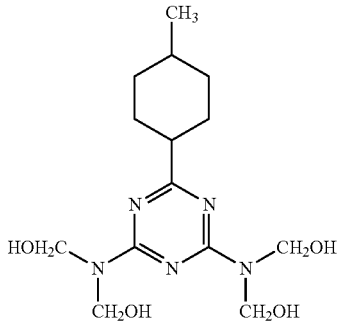
TABLE 14-2
C2-11
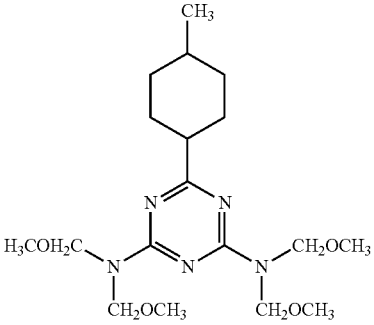
C2-12
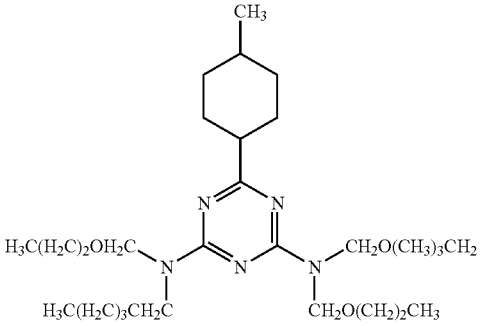

TABLE 14-2-continued
C2-13
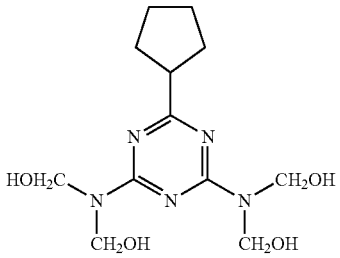
C2-14
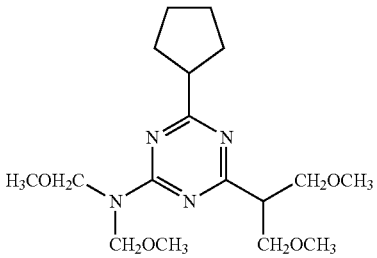
C2-15
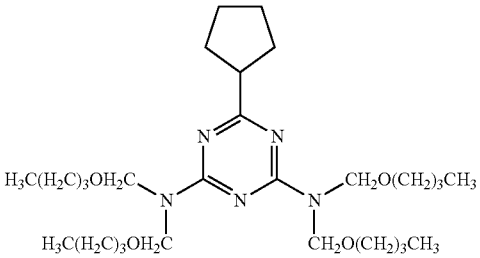
C2-16
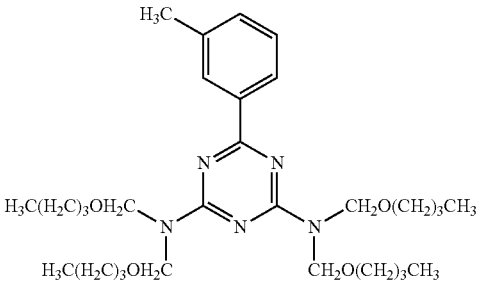
C2-17
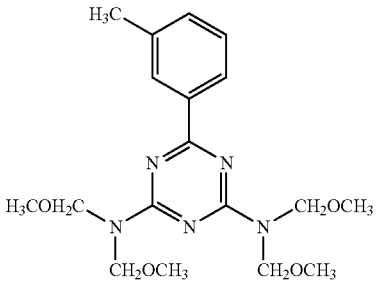
TABLE 14-2-continued
C2-18
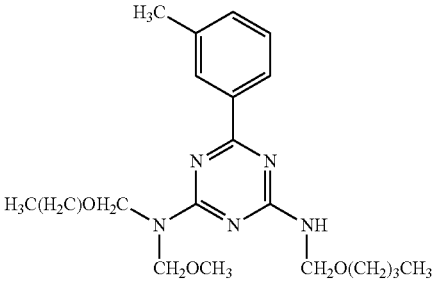
Specific examples of the compound represented by formula (C3) are described in Table 15 below.
TABLE 15
C3-1
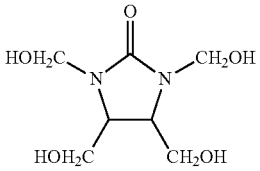
C3-2
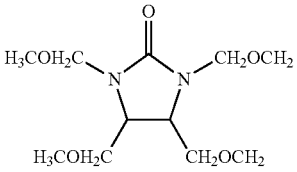
C3-3
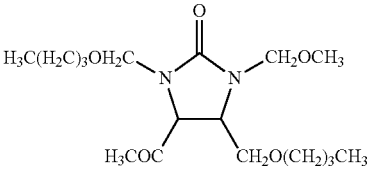
C3-4
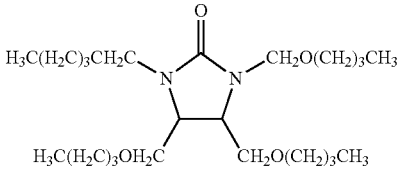
C3-5
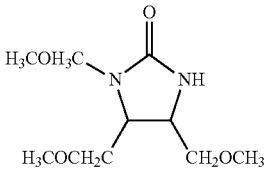
C3-6
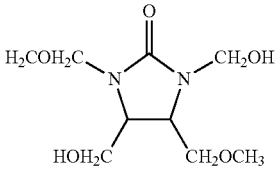
Specific examples of the compound represented by formula (C4) are described in Table 16 below.

TABLE 16

C4-1

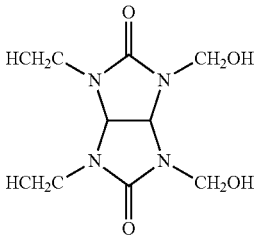

C4-2

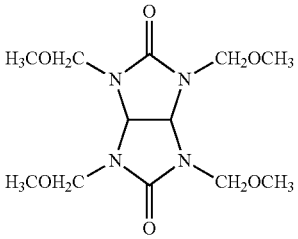

C4-3

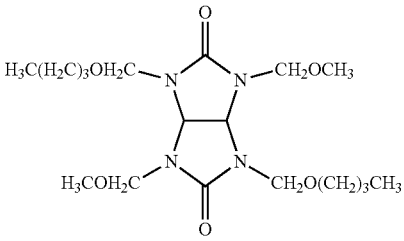

C4-4

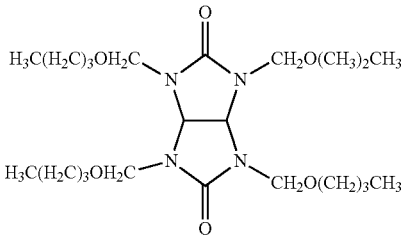

C4-5

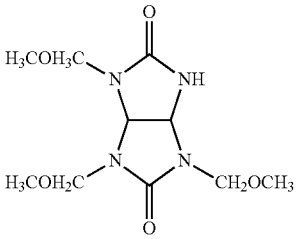

C4-6

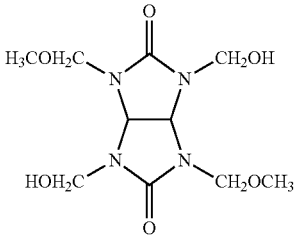

Specific examples of the compound represented by formula (C5) are described in Table 17 below.

TABLE 17

C5-1

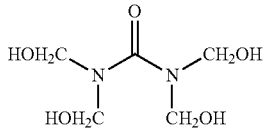

C5-2

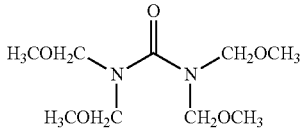

C5-3

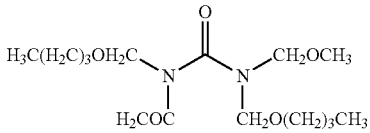

C5-4

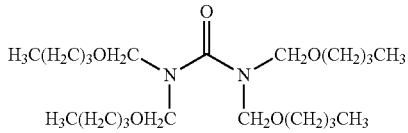

C5-5

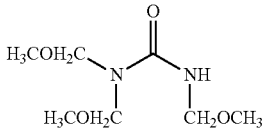

C5-6

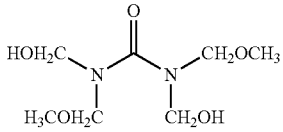

Resin

Examples of the resin used in the undercoat layer include acrylic resin, allyl resin, alkyd resin, ethylcellulose resin, ethylene-acrylic acid copolymers, epoxy resin, casein resin, silicone resin, gelatin resin, phenolic resin, butyral resin, polyacrylate resin, polyacetal resin, polyamideimide resin, polyamide resin, polyallyl ether resin, polyimide resin, polyurethane resin, polyether resin, polyethylene resin, polycarbonate resin, polystyrene resin, polysulfone resin, polyvinyl alcohol resin, polybutadiene resin, polypropylene resin, urea resin, agarose resin, and cellulose resin.

The resin used in the undercoat layer may be a thermoplastic resin having a polymerizable functional group.

The thermoplastic resin having a polymerizable functional group may be a thermoplastic resin having a constitutional unit represented by formula (D) below.

Formula (D)

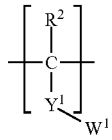

In Formula (D), $R^2$ represents a hydrogen atom or an alkyl group, $Y^1$ represents a single bond, an alkylene group, or a phenylene group, and $W^1$ represents a hydroxy group, a thiol group, an amino group, a carboxyl group, or a methoxy group.

Examples of the thermoplastic resin having a constitutional unit represented by formula (D) include acetal resin, polyolefin resin, polyester resin, polyether resin, and polyamide resin. The constitutional unit represented by formula (D) may be included in the characteristic structure shown below or may be found outside the characteristic structure. The characteristic structures are shown by (E-1) to (E-5) below. (E-1) is a constitutional unit of acetal resin. (E-2) is a constitutional unit of polyolefin resin. (E-3) is a constitutional unit of polyester resin. (E-4) is a constitutional unit of polyether resin. (E-5) is a constitutional unit of polyamide resin.

(E-1)

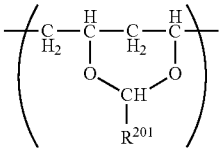

(E-2)

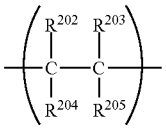

(E-3)

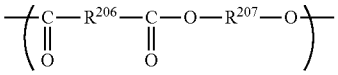

(E-4)

(E-5)

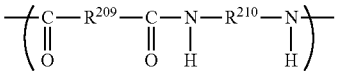

In the formulae above, $R^{201}$ to $R^{210}$ each independently represent a substituted or unsubstituted alkyl group or a substituted or unsubstituted aryl group. When $R^{201}$ represents $C_3H_8$ (butyl group), "Butyral" is indicated.

The resin having a constitutional unit represented by formula (D) (this resin may be referred to as "resin D" hereinafter) is obtained by, for example, polymerizing a monomer having a polymerizable functional group commercially available from Sigma-Aldrich Japan Co., or Tokyo Chemical Industry, Co., Ltd. Examples of the polymerizable functional group include a hydroxy group, a thiol group, an amino group, a carboxyl group, and a methoxy group.

The resin D is also commercially available. Examples of the commercially available resin include polyether polyol resin such as AQD-457 and AQD-473 produced by Nippon Polyurethane Industry CO., Ltd., and SANNIX GP-400 and GP-700 produced by Sanyo Chemical Industries Ltd., polyester polyol resin such as PHTHALKYD W2343 produced by Hitachi Chemical Co., Ltd., WATERSOL S-118 and CD-520 and BECKOLITE M-6402-50 and M-6201-401M produced by DIC Corporation, HARIDIP WH-1188 produced by Harima Chemicals Group, Inc., and ES3604 and ES6538 produced by U-PICA Company Ltd., polyacryl polyol resin such as BURNOCK WE-300 and WE-304 produced by DIC Corporation, polyvinyl alcohol resin such as KURARAY POVAL PVA-203 produced by Kuraray Co., Ltd., polyvinyl acetal resin such as BX-1 and BM-1 produced by Sekisui Chemical Co., Ltd., polyamide resin such as TRESIN FS-350 produced by Nagase ChemteX Corporation, carboxyl-group-containing resin such as AQUALIC produced by Nippon Shokubai Co, Ltd., and FINELEX SG2000 produced by NAMARIICHI Co., Ltd., polyamine resin such as LUCKAMIDE produced by DIC Corporation, and polythiol resin such as QE-340M produced by Toray Industries, Inc. Among these, polyvinyl acetal resin and polyester polyol resin may be used from the viewpoint of evenness of the electron transport layer.

The weight-average molecular weight (Mw) of the resin D may be in the range of 5,000 to 400,000.

Examples of the method for determining the quantity of the polymerizable functional groups in the resin are as follows:

titration of carboxyl groups with potassium hydroxide;

titration of amino groups with sodium nitrite;

titration of hydroxyl groups with acetic anhydride and potassium hydroxide; and titration of thiol groups with 5,5'-dithiobis(2-nitrobenzoic acid).

A calibration curve method that uses calibration curves obtained from IR spectra of samples with varying polymerizable-functional-group introduction ratios may also be employed.

Specific examples of the resin D are described in Table 18 below.

TABLE 18

| | Structure | | | Number of moles of | Characteristic | Weight-average |
|---|---|---|---|---|---|---|
| | $R^2$ | $Y^1$ | $W^1$ | functional groups per gram | moiety | molecular weight |
| D1 | H | Single bond | OH | 3.3 mmol | Butyral | $1 \times 10^5$ |
| D2 | H | Single bond | OH | 3.3 mmol | Butyral | $4 \times 10^4$ |
| D3 | H | Single bond | OH | 3.3 mmol | Butyral | $2 \times 10^4$ |
| D4 | H | Single bond | OH | 1.0 mmol | Polyolefin | $1 \times 10^5$ |
| D5 | H | Single bond | OH | 3.0 mmol | Polyester | $8 \times 10^4$ |
| D6 | H | Single bond | OH | 2.5 mmol | Polyether | $5 \times 10^4$ |
| D7 | H | Single bond | OH | 2.1 mmol | Polyether | $2 \times 10^5$ |
| D8 | H | Single bond | COOH | 3.5 mmol | Polyolefin | $6 \times 10^4$ |
| D9 | H | Single bond | $NH_2$ | 1.2 mmol | Polyamide | $2 \times 10^5$ |
| D10 | H | Single bond | SH | 1.3 mmol | Polyolefin | $9 \times 10^3$ |
| D11 | H | Phenylene | OH | 2.8 mmol | Polyolefin | $4 \times 10^3$ |
| D12 | H | Single bond | OH | 3.0 mmol | Butyral | $7 \times 10^4$ |
| D13 | H | Single bond | OH | 2.9 mmol | Polyester | $2 \times 10^4$ |
| D14 | H | Single bond | OH | 2.5 mmol | Polyester | $6 \times 10^3$ |
| D15 | H | Single bond | OH | 2.7 mmol | Polyester | $8 \times 10^4$ |
| D16 | H | Single bond | COOH | 1.4 mmol | Polyolefin | $2 \times 10^5$ |
| D17 | H | Single bond | COOH | 2.2 mmol | Polyester | $9 \times 10^3$ |

TABLE 18-continued

| | Structure | | | Number of moles of | Characteristic | Weight-average |
|---|---|---|---|---|---|---|
| | $R^2$ | $Y^1$ | $W^1$ | functional groups per gram | moiety | molecular weight |
| D18 | H | Single bond | COOH | 2.8 mmol | Polyester | $8 \times 10^2$ |
| D19 | $CH_3$ | Alkylene | OH | 1.5 mmol | Polyester | $2 \times 10^4$ |
| D20 | $C_2H_5$ | Alkylene | OH | 2.1 mmol | Polyester | $1 \times 10^4$ |
| D21 | $C_2H_5$ | Alkylene | OH | 3.0 mmol | Polyester | $5 \times 10^4$ |
| D22 | H | Single bond | $OCH_3$ | 2.8 mmol | Polyolefin | $7 \times 10^3$ |
| D23 | H | Single bond | OH | 3.3 mmol | Butyral | $2.7 \times 10^5$ |
| D24 | H | Single bond | OH | 3.3 mmol | Butyral | $4 \times 10^5$ |
| D25 | H | Single bond | OH | 2.5 mmol | Acetal | $3.4 \times 10^5$ |

Examples of the solvent used in the coating liquid for forming an undercoat layer include benzene, toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethylformamide, dimethylacetamide, and dimethyl sulfoxide.

When at least an electron transport substance and a crosslinking agent are contained in the undercoat layer, the number of moles of (polymerizable) functional groups per gram of the electron transport substance is assumed to be $M_1$, that per gram of the crosslinking agent is assumed to be $M_2$, and that per gram of the resin is assumed to be $M_3$, and the number of moles of (polymerizable) functional groups per gram of unreacted compound not contributing to polymerization is assumed to be $M_4$. In order to further reduce leaching of the unreacted electron transport substance or crosslinking agent into the charge generation layer, $M_4/(M_1+M_2+M_3)$ is preferably 50% or less and more preferably 20% or less. For example, when all of the polymerizable functional groups of the electron transport substance and the resin are —OH groups and all of the polymerizable functional groups of the crosslinking agent are —NCO groups, the following is preferable: $|(M_1+M_3-M_2)/(M_1+M_3+M_2)| \leq 1/2$, where $M_1$, $M_2$, and $M_3$ are the ratios in the coating liquid for forming an undercoat layer. More preferably, $|(M_1+M_3-M_2)/(M_1+M_3+M_2)| \leq 1/5$ is satisfied.

The thickness of the undercoat layer is preferably 0.1 to 30.0 μm.

Charge Generation Layer

A charge generation layer is disposed on the undercoat layer.

The charge generation layer contains a gallium phthalocyanine crystal and an amide compound represented by formula (N1):

Formula (N1)

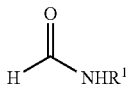

The amount of the amide compound represented by formula (N1) may be 0.1% by mass or more and 3.0% by mass or less based on the total mass of the charge generation layer. When the amount of the amide compound is within this range, the ghosting reducing effect can be further improved.

From the viewpoints of reducing ghosting and improving sensitivity, the amide compound represented by formula (N1) may be contained inside the gallium phthalocyanine crystal. When the amide compound represented by formula (N1) is contained inside the gallium phthalocyanine crystal, the gallium phthalocyanine crystal incorporates the amide compound represented by formula (N1).

The amount of the amide compound represented by formula (N1) contained inside the gallium phthalocyanine crystal is preferably 0.1% by mass or more and 3.0% by mass or less and more preferably 0.1% by mass or more and 1.7% by mass or less based on the amount of gallium phthalocyanine inside the gallium phthalocyanine crystal.

When the amount of the electron transport substance based on the total mass of the undercoat layer is represented by PA (unit: % by mass) and the amount of the amide compound represented by formula (N1) based on the total mass of the charge generation layer is represented by PN (unit: % by mass), the PN/PA ratio may be 0.005 or more and 0.080 or less. When PN/PA is within the above-described range, electrons travel more efficiently from the charge generation layer containing the gallium phthalocyanine crystal to the undercoat layer.

In formula (N1), $R^1$ may represent a methyl group. An amide compound represented by formula (N1) with $R^1$ representing a methyl group has high compatibility with gallium phthalocyanine and a high tendency to polarize. Accordingly, the amide compound is easily incorporated into the gallium phthalocyanine crystal, and accumulation of charges inside the crystal which causes ghosting is presumably further reduced. The compound represented by formula (N1) with $R^1$ representing a methyl group is also known as N-methylformamide.

An example of the gallium phthalocyanine crystal is a crystal that has a halogen atom, a hydroxy group, or an alkoxy group as the axial ligand for the gallium atom in the gallium phthalocyanine molecule. The phthalocyanine ring may have a substituent such as a halogen atom.

Among gallium phthalocyanine crystals, a hydroxygallium phthalocyanine crystal, a chlorogallium phthalocyanine crystal, a bromogallium phthalocyanine crystal, or a iodogallium phthalocyanine crystal that has excellent sensitivity may be used. Among these, a hydroxygallium phthalocyanine crystal and a chlorogallium phthalocyanine crystal are more preferable. A hydroxygallium phthalocyanine crystal has a hydroxy group as an axial ligand for the gallium atom. A bromogallium phthalocyanine crystal has a bromine atom as an axial ligand for the gallium atom. The iodogallium phthalocyanine crystal has an iodine atom as the axial ligand for the gallium atom.

The hydroxygallium phthalocyanine crystal may be a hydroxygallium phthalocyanine having a crystal form having peaks at Bragg angles 2θ of 7.4°±0.3° and 28.2°±0.3° in X-ray diffraction with a Cu Kα radiation from the viewpoint of high image quality.

The charge generation layer can be formed by forming a coating film with a coating liquid for forming a charge generation layer obtained by dispersing the gallium phthalocyanine crystal, the amide compound represented by formula (N1), and the binder resin in a solvent, and drying the coating film. As described above, the amide compound represented by formula (N1) within the crystal may be contained inside the gallium phthalocyanine crystal.

Dispersing may be conducted with a disperser. Examples of the disperser include media dispersers such as a sand mill and a ball mill, and liquid-collision-type dispersers.

The thickness of the charge generation layer is preferably 0.05 to 1 μm and more preferably 0.05 to 0.2 μm.

The amount of the gallium phthalocyanine crystal in the charge generation layer is preferably 30% by mass or more and 90% by mass or less and more preferably 50% by mass or more and 80% by mass or less based on the total mass of the charge generation layer.

Examples of the binder resin used in the charge generation layer include polyester resin, acrylic resin, phenoxy resin, polycarbonate resin, polyvinyl butyral resin, polystyrene resin, polyvinyl acetate resin, polysulfone resin, polyarylate resin, vinylidene chloride resin, acrylonitrile copolymers, and polyvinyl benzal resin. Among these, polyvinyl butyral resin and polyvinyl benzal resin are preferable.

The gallium phthalocyanine crystal according to the present invention is obtained by a process of crystal transformation that involves wet-milling a gallium phthalocyanine obtained by an acid pasting technique and the amide compound represented by formula (N1). The amide compound represented by formula (N1) is N-methylformamide, N-propylformamide, or N-vinylformamide.

Milling is the process that uses a milling device such as a sand mill or a ball mill along with a dispersing agent such as glass beads, steel beads, or alumina balls. The amount of the dispersing agent used in the milling is preferably 10 to 50 times larger than the amount of gallium phthalocyanine on a mass basis. Examples of the solvent used include amide solvents such as N,N-dimethylformamide, N,N-dimethylacetamide, the compound represented by formula (N1), N-methylacetamide, and N-methylpropioamide, halogen solvents such as chloroform, ether solvents such as tetrahydrofuran, and sulfoxide solvents such as dimethyl sulfoxide.

The amount of the solvent used may be 5 to 30 times larger than the amount of gallium phthalocyanine on a mass basis.

The inventors have discovered that the amount of the compound represented by formula (N1) incorporated into the gallium phthalocyanine crystal decreases with the increase in the length of the crystal transformation time. Further studies have been conducted and it has been found that a gallium phthalocyanine crystal that contains, inside the crystal, a particular amount of the amide compound represented by formula (N1) is particularly preferable for reducing ghosting.

Whether the amide compound represented by formula (N1) is contained inside the gallium phthalocyanine crystal of the present invention is determined by analyzing the $^1$H-NMR data of the obtained gallium phthalocyanine crystal. The amount of the amide compound represented by formula (N1) inside the crystal is also determined by analyzing the $^1$H-NMR data.

For example, when milling or washing after milling is performed with a solvent that can dissolve the amide compound represented by formula (N1), the gallium phthalocyanine crystal obtained is subjected to $^1$H-NMR measurement. When the amide compound represented by formula (N1) is detected, it can be determined that the amide compound represented by formula (N1) is contained inside the crystal.

The $^1$H-NMR measurement and X-ray diffraction of the gallium phthalocyanine crystal contained in the electrophotographic photoconductor of the present invention are conducted under the following conditions:

$^1$H-NMR measurement
Instrument used: AVANCE III 500 produced by BRUKER Corporation
Solvent: deuterated sulfuric acid ($D_2SO_4$)
Number of transients: 2,000
Powder X-ray diffraction measurement
Instrument used: X-ray diffractometer RINT-TTR II produced by Rigaku Corporation
X-ray bulb: Cu
Bulb voltage: 50 KV
Bulb current: 300 mA
Scanning method: 2θ/θ scanning
Scanning speed: 4.0°/min
Sampling width: 0.02°
Start angle (2θ): 5.0°
Stop angle (2θ): 40.0°
Attachment: Standard sample holder
Filter: not used
Incident monochromater: used
Counter monochromater: not used
Divergence slit: open
Divergence height-limiting slit: 10.00 mm
Scattering slit: open
Receiving slit: open
Flat monochromater: used
Counter: scintillation detector Hole transport layer A hole transport layer is formed on the charge generation layer.

The hole transport layer can be obtained by forming a coating film with a coating liquid for forming a hole transport layer containing a hole transport substance and a binder resin, and drying the coating film.

The amount of the hole transport substance is preferably 20% to 80% by mass and more preferably 30% to 60% by mass based on the total mass of the hole transport layer.

Examples of the hole transport substance include polycyclic aromatic compounds, heterocyclic compounds, hydrazone compounds, styryl compounds, benzidine compounds, triarylamine compounds, and triphenyl amine. A polymer that has, in a main chain or a side chain, a group derived from any of these compounds may also be used. Among these, triarylamine compounds, styryl compounds, and benzidine compounds are preferable and triarylamine compounds are particularly preferable. These hole transport substances may be used alone or in combination.

Examples of the binder resin used in the hole transport layer include polyester resin, acrylic resin, phenoxy resin, polycarbonate resin, polystyrene resin, polyvinyl acetate resin, polysulfone resin, polyarylate resin, vinylidene chloride resin, and acrylonitrile copolymers. Among these, polycarbonate resin and polyarylene resin are preferable. Polycarbonate resin and polyester resin may be used alone, or in combination as a mixture or a copolymer. The form of the copolymer may be any, for example, the copolymer may be a block copolymer, a random copolymer, or an alternating copolymer. The weight-average molecular weight (Mw) of the binder resin may be 10,000 to 300,000.

The thickness of the hole transport layer is preferably 5 to 40 μm and more preferably 10 to 25 μm.

Protective Layer

A protective layer may be formed on the hole transport layer in order to protect the charge generation layer and the hole transport layer.

The protective layer can be obtained by forming a coating film with a coating liquid for forming a protective layer obtained by dissolving a resin in an organic solvent, and drying the coating film. Examples of the resin used in the protective layer include polyvinyl butyral resin, polyester resin, polycarbonate resin (polycarbonate Z resin, modified polycarbonate resin, etc.), nylon resin, polyimide resin, polyarylate resin, polyurethane resin, styrene-butadiene copolymers, styrene-acrylic acid copolymers, and styrene-acrylonitrile copolymers. Alternatively, the protective layer may be formed by forming a coating film on the charge transport layer by using a coating liquid for forming a protective layer, heating the coating film, and curing the heated coating film with an electron beam, an ultraviolet ray, or the like.

The thickness of the protective layer may be 0.05 to 20 μm.

The protective layer may contain conductive particles, an UV absorber, lubricating particles such as fluorine-containing resin fine particles, etc. The conductive particles may be metal oxide particles such as tin oxide particles, for example.

The coating method employed to form each layer may be a dip-coating method (dipping method), a spray coating method, a spinner coating method, a bead coating method, a blade coating method, a beam coating method, or the like. The dip-coating method is preferable from the viewpoints of efficiency and productivity.

Process Cartridge and Electrophotographic Apparatus

Figure 2:
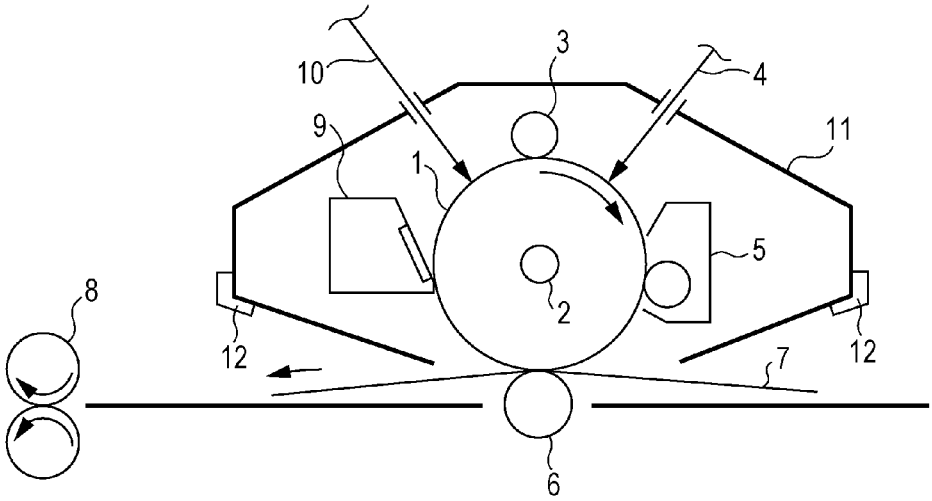
FIG. 2 is a schematic diagram of an electrophotographic apparatus that includes a process cartridge that includes an electrophotographic photoconductor.

FIG. 2 is a schematic diagram of an electrophotographic apparatus that includes a process cartridge that includes an electrophotographic photoconductor.

In FIG. 2, a cylindrical (drum-shaped) electrophotographic photoconductor 1 is rotated and driven in the arrow direction about an axis 2 at a predetermined circumferential velocity (process speed).

The surface of the electrophotographic photoconductor 1 is charged to a particular positive or negative potential by a charging device 3 in the course of rotation. Then the charged surface of the electrophotographic photoconductor 1 is irradiated with exposure light 4 from an exposing device (not shown in the drawing) to form an electrostatic latent image that corresponds to desired image data. The exposure light 4 is, for example, light output from an exposing device that employs a slit exposure or laser beam scanning exposure technique, and has the intensity modified on the basis of time-series electrical digital image signals of a target image data.

The electrostatic latent image formed on the surface of the electrophotographic photoconductor 1 is developed (normal development or reversal development) with a toner in a developing device 5 to form a toner image on the surface of the electrophotographic photoconductor 1. The toner image on the surface of the electrophotographic photoconductor 1 is transferred onto a transfer material 7 by using a transfer device 6. During this process, a bias voltage having a polarity opposite to the charges of the toner is applied to the transfer device 6 from a bias power supply (not shown in the drawing). When the transfer material 7 is a paper sheet, the transfer material 7 is taken out from a paper storage (not shown in the drawing) and fed in synchronicity with the rotation of the electrophotographic photoconductor 1 so as to be fed between the electrophotographic photoconductor 1 and the transfer device 6.

The transfer material 7 receiving the toner image from the electrophotographic photoconductor 1 is separated from the surface of the electrophotographic photoconductor 1, conveyed to a fixing device 8 so as to have the toner image fixed onto the transfer material 7. The transfer material 7 is then output from the electrophotographic apparatus as an image-carrying article (print or copy).

The surface of the electrophotographic photoconductor 1 after the transfer of the toner image onto the transfer material 7 is cleaned with a cleaning device 9 so as to have adhering matter such as the toner (transfer residual toner) removed. Owing to the cleaner-less system developed recently, the transfer residual toner can be directly removed with a developing unit or the like. The surface of the electrophotographic photoconductor 1 is irradiated with preexposure light 10 from a preexposure device (not shown in the drawing) so as to remove charges, and then the electrophotographic photoconductor 1 is repeatedly used in image formation. When the charging device 3 is a contact charging device that uses a charging roller or the like, the preexposure device is not always necessary.

In the present invention, two or more elements from the elements constituting the apparatus, such as the electrophotographic photoconductor 1, the charging device 3, the developing device 5, and the cleaning device 9, can be housed in a container so as to be integrally supported by the container and form a process cartridge. This process cartridge may be detachably attachable to a main body of the electrophotographic apparatus. For example, at least one selected from the charging device 3, the developing device 5, and the cleaning device 9, and the electrophotographic photoconductor 1 may be integrated into a cartridge. This cartridge can function as a process cartridge 11 detachably attachable to a main body of the electrophotographic apparatus when a guiding unit 12 such as a rail of the main body of the electrophotographic apparatus is used.

When the electrophotographic apparatus is a copier or a printer, the exposure light 4 may be light reflected at or transmitted through the original. The exposure light 4 may be light generated by scanning a laser beam based on a signal obtained by reading the original with a sensor or driving an LED array or a liquid crystal shutter array based on such a signal.

The electrophotographic photoconductor 1 of the present invention can be adopted to a wide spectrum of electrophotographic applications such as laser beam printers, CRT printers, LED printers, facsimile machines, liquid crystal printers, and laser plate manufacturing.

EXAMPLES

The present invention will now be described in further detail through specific examples. In the description below, "parts" means "parts by mass" and "%" means "% by mass". These examples do not limit the scope of the present invention. The thickness of each layer of the electrophotographic photoconductors of Examples and Comparative Examples was determined by an eddy-current thickness meter (Fischerscope produced by Fischer Instruments K.K. Japan) by conversion based on the mass per unit area.

Synthesis of Gallium Phthalocyanine Pigment

Synthetic Example 1

Under nitrogen flow, 5.46 parts of phthalonitrile and 45 parts of α-chloronaphthalene were placed in a reactor and heated to a temperature of 30° C., and this temperature was retained. Next, 3.75 parts of gallium trichloride was added to the resulting mixture at this temperature (30° C.) The water content of the mixture at the time gallium trichloride was added was 150 ppm. The resulting mixture was then heated to 200° C. Under nitrogen flow, the mixture was allowed to react at 200° C. for 4.5 hours and cooled. The reaction product was filtered when the temperature reached 150° C. The residue obtained was dispersed in and washed with N,N-dimethylformamide at 140° C. for 2 hours, and then the resulting dispersion was filtered. The residue was washed with methanol and dried. As a result, 4.65 parts (71% yield) of a chlorogallium phthalocyanine pigment was obtained.

Synthetic Example 2

In 139.5 parts of concentrated sulfuric acid, 4.65 parts of the chlorogallium phthalocyanine pigment obtained in Synthetic Example 1 was dissolved at 10° C. The resulting solution was added dropwise to 620 parts of ice water under stirring to allow reprecipitation, and the resulting mixture was filtered with a filter press. The obtained wet cake (residue) was dispersed in and washed with 2% aqueous ammonia, and the resulting dispersion was filtered with a filter press. The obtained wet cake (residue) was dispersed in and washed with ion exchange water, and filtration with a filter press was conducted three times. As a result, an aqueous hydroxygallium phthalocyanine pigment having a solid content of 23% was obtained.

Hyper-dry dryer (trade name: HD-06R, frequency (oscillation frequency): 2455 MHz±15 MHz, produced by BIO-CON (JAPAN) LTD.) was used to dry 6.6 kg of the obtained aqueous hydroxygallium phthalocyanine pigment as follows.

The aqueous hydroxygallium phthalocyanine pigment in the form of mass (wet cake with a thickness of 4 cm or less) as discharged from the filter press was placed on a special circular plastic tray. The infrared ray was turned off, and the inner wall temperature of the dryer was set to 50° C. During microwave irradiation, a vacuum pump and a leak valve were adjusted so that the degree of vacuum was 4.0 to 10.0 kPa.

In a first step, the hydroxygallium phthalocyanine pigment was irradiated with a 4.8 kW microwave for 50 minutes, the microwave was then turned off, and the leak valve was closed to create a high vacuum of 2 kPa or less. The solid content of the hydroxygallium phthalocyanine pigment at this point was 88%.

In a second step, the leak valve was adjusted so that the degree of vacuum (pressure inside the dryer) was within the above-described setting range (4.0 to 10.0 kPa). Then the hydroxygallium phthalocyanine pigment was irradiated with a 1.2 kW microwave for 5 minutes, the microwave was turned off, and the leak valve was closed to create a high vacuum of 2 kPa or less. This second step was repeated once (the second step was performed twice in a total). The solid content of the hydroxygallium phthalocyanine pigment at this point was 98%.

In a third step, microwave irradiation was performed as in the second step except that the output of the microwave was changed from 1.2 kW in the second step to 0.8 kW. The third step was repeated once (the third step was performed twice in total).

In a fourth step, the leak valve was adjusted and the degree of vacuum (pressure inside the dryer) was returned to the above-described setting range (4.0 to 10.0 kPa). Then the hydroxygallium phthalocyanine pigment was irradiated with a 0.4 kW microwave for 3 minutes. The microwave was turned off, and the leak valve was closed to create a high vacuum of 2 kPa or less. The fourth step was repeated seven times (the fourth step was performed eight times in total).

As a result, 1.52 kg of the hydroxygallium phthalocyanine pigment with a water content of 1% or less was obtained in a total of 3 hours.

Examples 1-1 to 1-7

Example 1-1

Figure 3:
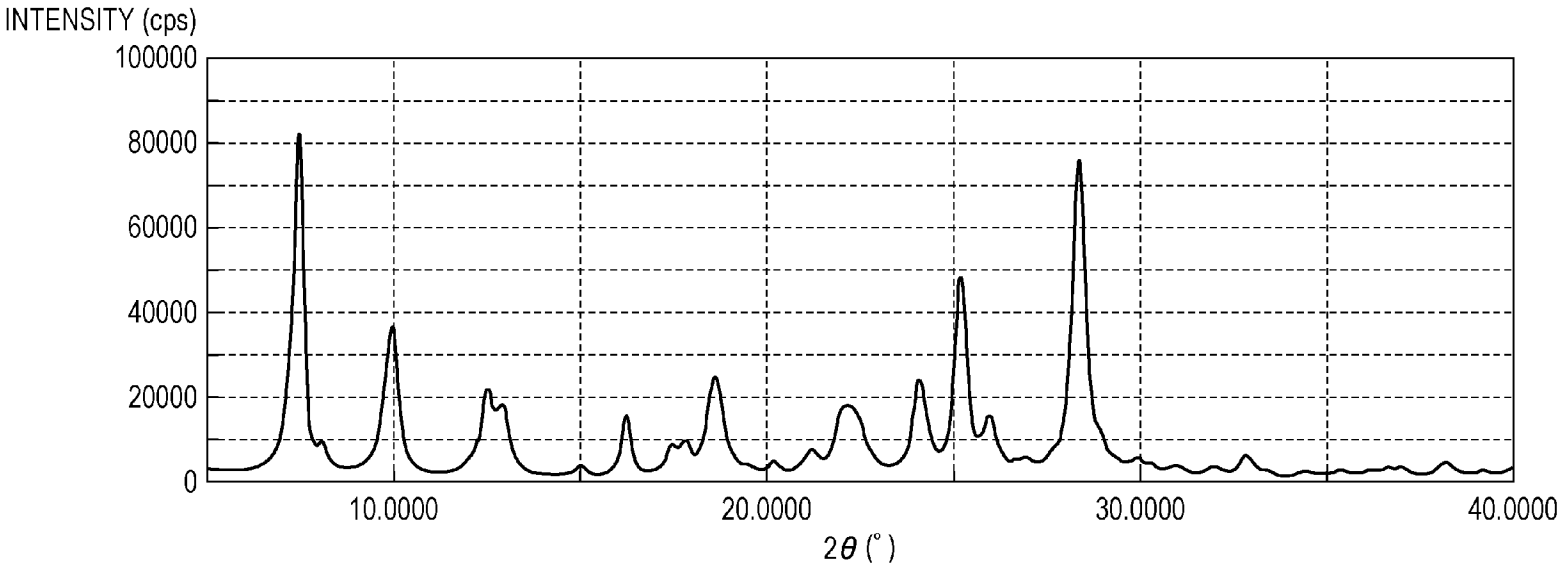
FIG. 3 is a powder X-ray diffraction pattern of a hydroxygallium phthalocyanine crystal obtained in Example 1-1.

At room temperature (23° C.), 0.5 part of the hydroxygallium phthalocyanine pigment obtained in Synthetic Example 2 and 9.5 parts of N-methylformamide were milled with 15 parts of glass beads 0.8 mm in diameter in a ball mill for 2000 hours. This milling was conducted by using a standard jar (product code: PS-6, produced by Hakuyo Glass Co., Ltd.) as a container under conditions that the container was rotated 60 times per minute. To the resulting dispersion, 30 parts of N-methylformamide was added, the resulting mixture was filtered with a filter, and the residue remaining in the filter was thoroughly washed with tetrahydrofuran. The washed residue was vacuum dried. As a result, 0.45 parts of a hydroxygallium phthalocyanine crystal was obtained. The power X-ray diffraction pattern of the obtained crystal is shown in FIG. 3.

$^1$H-NMR measurement confirmed that 0.6% by mass of N-methylformamide was contained in the obtained hydroxygallium phthalocyanine crystal, as calculated based on the proton ratio.

Example 1-2

A hydroxygallium phthalocyanine crystal of Example 1-2 was obtained as in Example 1-1 except that the length of the time of milling performed in the ball mill was changed from 2000 hours in Example 1-1 to 1000 hours. The powder X-ray diffraction pattern of the obtained crystal was similar to one shown in FIG. 3.

As in Example 1-1, $^1$H-NMR measurement confirmed that 0.7% by mass of N-methylformamide was contained in the obtained hydroxygallium phthalocyanine crystal.

Example 1-3

A hydroxygallium phthalocyanine crystal of Example 1-3 was obtained as in Example 1-1 except that the length of the time of milling performed in the ball mill was changed from 2000 hours in Example 1-1 to 100 hours. The powder X-ray diffraction pattern of the obtained crystal was similar to one shown in FIG. 3.

Figure 5:
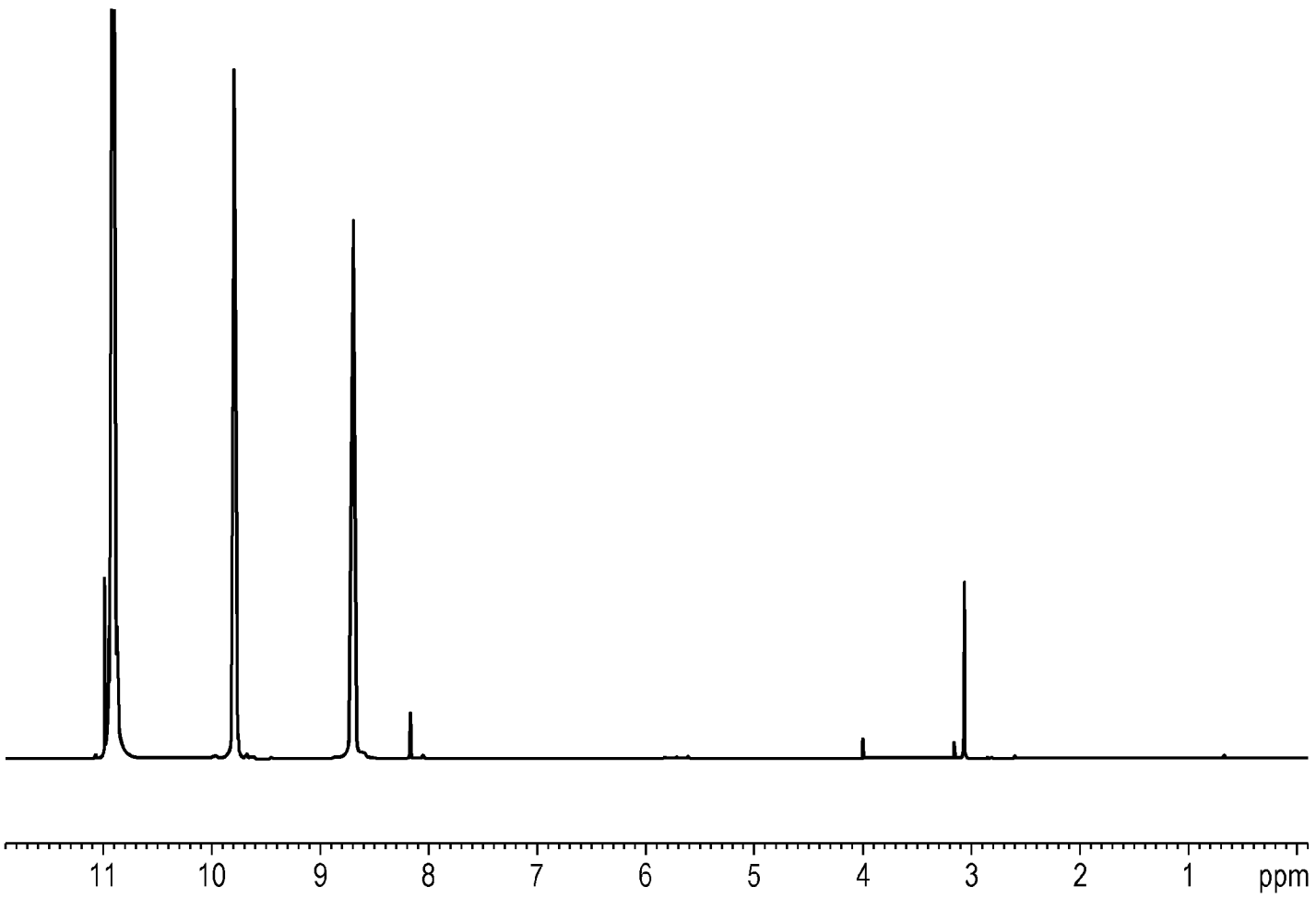
FIG. 5 is an $^1$H-NMR spectrum of a hydroxygallium phthalocyanine crystal obtained in Example 1-3.

As in Example 1-1, $^1$H-NMR measurement confirmed that 2.1% by mass of N-methylformamide was contained in the obtained hydroxygallium phthalocyanine crystal. The $^1$H-NMR spectrum of the obtained hydroxygallium phthalocyanine crystal is shown in FIG. 5.

Example 1-4

A hydroxygallium phthalocyanine crystal of Example 1-4 was obtained as in Example 1-1 except that the length of the time of milling performed in the ball mill was changed from 2000 hours in Example 1-1 to 30 hours. The powder X-ray diffraction pattern of the obtained crystal was similar to one shown in FIG. 3.

As in Example 1-1, $^{1}$H-NMR measurement confirmed that 3.3% by mass of N-methylformamide was contained in the obtained hydroxygallium phthalocyanine crystal.

Example 1-5

At room temperature (23° C.), 0.5 parts of the hydroxygallium phthalocyanine pigment obtained in Synthetic Example 2 and 9.5 parts of N,N-dimethylformamide were milled with 15 parts of glass beads 0.8 mm in diameter in a ball mill for 100 hours. This milling was conducted by using a standard jar (product code: PS-6, produced by Hakuyo Glass Co., Ltd.) as a container under conditions that the container was rotated 60 times per minute. To the resulting dispersion, 30 parts of N,N-dimethylformamide was added, the resulting mixture was filtered with a filter, and the residue remaining in the filter was thoroughly washed with tetrahydrofuran. The washed residue was vacuum dried. As a result, 0.45 parts of a hydroxygallium phthalocyanine crystal was obtained. The power X-ray diffraction pattern of the obtained crystal was similar to one shown in FIG. 3.

As in Example 1-1, $^{1}$H-NMR measurement confirmed that 2.1% by mass of N,N-dimethylformamide was contained in the obtained hydroxygallium phthalocyanine crystal.

Example 1-6

At room temperature (23° C.), 0.5 part of the hydroxygallium phthalocyanine pigment obtained in Synthetic Example 2 and 9.5 parts of N-propylformamide were milled with 15 parts of glass beads 0.8 mm in diameter in a ball mill for 1100 hours. This milling was conducted by using a standard jar (product code: PS-6, produced by Hakuyo Glass Co., Ltd.) as a container under conditions that the container was rotated 60 times per minute. To the resulting dispersion, 30 parts of N-propylformamide was added, the resulting mixture was filtered with a filter, and the residue remaining in the filter was thoroughly washed with tetrahydrofuran. The washed residue was vacuum dried. As a result, 0.46 part of a hydroxygallium phthalocyanine crystal was obtained. The power X-ray diffraction pattern of the obtained crystal was similar to one shown in FIG. 3.

As in Example 1-1, $^{1}$H-NMR measurement confirmed that 0.7% by mass of N-propylformamide was contained in the obtained hydroxygallium phthalocyanine crystal.

Example 1-7

A hydroxygallium phthalocyanine crystal of Example 1-7 was obtained as in Example 1-6 except that the length of the time of milling performed in the ball mill was changed from 1100 hours in Example 1-6 to 300 hours. The powder X-ray diffraction pattern of the obtained crystal was similar to one shown in FIG. 3.

As in Example 1-1, $^{1}$H-NMR measurement confirmed that 1.4% by mass of N-propylformamide was contained in the obtained hydroxygallium phthalocyanine crystal.

Examples 2-1 to 2-55 and Comparative Examples 2-1 to 2-6

Example 2-1

An aluminum cylinder having a diameter of 24 mm and a length of 257 mm was used as a support (cylindrical support).

Next, following materials were placed in a ball mill:

tin-oxide-coated barium sulfate particles (trade name: Passtran PC1 produced by Mitsui Mining & Smelting Co.): 60 parts titanium oxide particles (trade name: TITANIX JR, produced by Tayca Corporation): 15 parts resole phenolic resin (trade name: PHENOLITE J-325, produced by DIC Corporation, solid content: 70% by mass): 43 parts silicone oil (trade name: SH28PA, produced by Dow Corning Toray Inc.): 0.015 part silicone resin particles (trade name: TOSPEARL 120, produced by Momentive Performance Material Toshiba Silicone Inc.): 3.6 parts 2-methoxy-1-propanol: 50 parts methanol: 50 parts The resulting mixture was dispersed for 20 hours to prepare a coating liquid for forming a conductive layer. The coating liquid for forming a conductive layer was applied to a support by dip-coating, and the resulting coating film was heated at 150° C. for 1 hour to be cured. As a result, a conductive layer having a thickness of 20 μm was formed.

Next, 4.5 parts of the electron transport substance (A117), 5.5 parts of a crosslinking agent (B1:protective group (H1) =5.1:2.2 (mass ratio)), 0.3 part of a resin (polyvinyl butyral resin having a partial structure represented by D1 (in formula (D), R2 represents a hydrogen atom, Y1 represents a single bond, and W1 represents a hydroxy group) and a partial structure represented by (E-1) with R201 representing C3H7), 0.05 part of zinc(II) hexanoate serving as a catalyst were dissolved in a mixed solvent containing 50 parts of tetrahydrofuran and 50 parts of 1-methoxy-2-propanol. The resulting mixture was stirred to prepare a coating liquid for forming an undercoat layer. The coating liquid for forming an undercoat layer was applied to the conductive layer by dip-coating, and the resulting coating film was heated at 160° C. for 60 minutes to conduct polymerization. As a result, an undercoat layer having a thickness of 0.6 μm was formed.

The amount PA of the electron transport substance based on the total mass of the undercoat layer was 44% by mass.

Into a sand mill charged with glass beads 1 mm in diameter, 20 parts of the hydroxygallium phthalocyanine crystal (charge generation substance) obtained in Example 1-1, 10 parts of polyvinyl butyral (trade name: S-LEC BX-1, produced by Sekisui Chemical Co., Ltd.), and 519 parts of cyclohexanone were placed. The resulting mixture was dispersed for 4 hours. To the resulting dispersion, 764 parts of ethyl acetate was added to prepare a coating liquid for forming a charge generation layer. The coating liquid for forming a charge generation layer was applied to the undercoat layer by dip-coating, and the resulting coating film was dried at 100° C. for 10 minutes to obtain a charge generation layer having a thickness of 0.15 μm.

The amount PN of the amide compound represented by formula (N1) based on the total mass of the charge generation layer was 0.37% by mass. PN/PA was 0.008.

Next, in 630 parts of monochlorobenzene, 70 parts of a triarylamine compound (hole transport substance) represented by formula (T1):

Formula (T1)

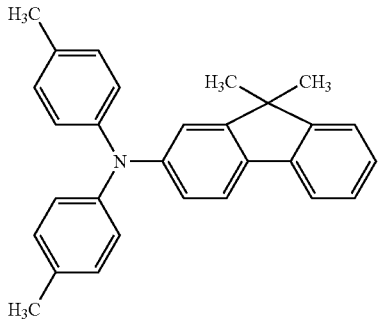

10 parts of a triarylamine compound (hole transport substance) represented by formula (T2):

Formula (T2)

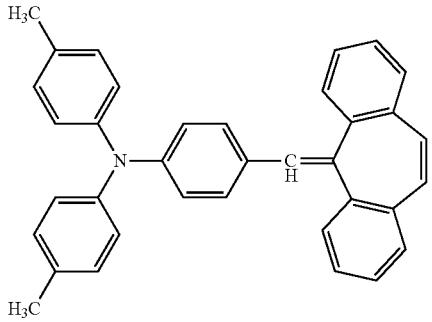

and 100 parts of a polycarbonate (trade name: Iupilon Z-200, produced by Mitsubishi Engineering-Plastics Corporation) were dissolved to prepare a coating liquid for forming a hole transport layer. The coating liquid for forming a hole transport layer was applied to the charge generation layer by dip-coating, and the resulting coating film was dried at 125° C. for 1 hour to prepare a hole transport layer having a thickness of 18 μm.

Heating of the coating films that form the conductive layer, the undercoat layer, the charge generation layer, and the hole transport layer was performed in an oven set to the designated temperature. The same applies to the description below.

A cylindrical electrophotographic photoconductor of Example 2-1 was prepared as above.

Example 2-2

An electrophotographic photoconductor of Example 2-2 was prepared as in Example 2-1 except that preparation of the coating liquid for forming a charge generation layer was changed as follows.

Into a sand mill charged with glass beads 1 mm in diameter, 20 parts of the hydroxygallium phthalocyanine crystal (charge generation substance) obtained in Example 1-1, 0.9 part of N-methylformamide, 10 parts of polyvinyl butyral (trade name: S-LEC BX-1, produced by Sekisui Chemical Co., Ltd.), and 519 parts of cyclohexanone were placed. The resulting mixture was dispersed for 4 hours. Then 764 parts of ethyl acetate was added to the resulting dispersion to prepare a coating liquid for forming a charge generation layer.

The amount PN of the amide compound represented by formula (N1) based on the total mass of the charge generation layer was 3.27% by mass. PN/PA was 0.075.

Examples 2-3 to 2-50

Electrophotographic photoconductors of Examples 2-3 to 2-48 were prepared as in Example 2-2 except that the coating liquid for forming an undercoat layer and the coating liquid for forming a charge generation layer were prepared as indicated in Tables 19-1 and 19-3. In Table 19-3, "Additive amide compound" means an amide compound added separate from the amide compound contained in the gallium phthalocyanine crystal in preparing the coating liquid for forming a charge generation layer.

Example 2-51

An electrophotographic photoconductor of Example 2-51 was prepared as in Example 2-1 except that the undercoat layer was formed as described below.

To a 100 mL three-necked flask, 1 g of the electron transport substance (A124) and 10 g of N,N-dimethylacetamide were added while feeding dry nitrogen gas. The resulting mixture was rigorously stirred at 25° C., and 5 mg of AIBN was added thereto. Then polymerization reaction was carried out at 65° C. for 50 hours while supplying nitrogen. Upon completion of the reaction, the reaction product was added to 500 mL of methanol dropwise under vigorous stirring, and precipitate was filtered out. The precipitate was dissolved in 10 g of N,N-dimethylacetamide, and the resulting solution was filtered. The filtrate was added to 500 mL of methanol dropwise to induce precipitation of a polymer. The polymer was filtered out, dispersed in and washed with 1 L of methanol, and dried. As a result, 0.89 g of a polymer of the electron transport substance was obtained. The molecular weight of the polymer of the electron transport substance obtained was measured by GPC (chloroform mobile phase). The weight-average molecular weight was 84,000.

A coating liquid for forming an undercoat layer was prepared from 6 parts of the polymer of the electron transport substance obtained, 10 parts of chlorobenzene, 0.03 part of zinc(II) octylate serving as a catalyst, and 90 parts of tetrahydrofuran. The coating liquid for forming an undercoat layer was applied to the conductive layer by dip-coating, and the resulting coating film was heated and cured at 125° C. for 30 minutes. As a result, an undercoat layer, i.e., a cured film, having a thickness of 0.6 μm was formed.

The amount PA of the electron transport substance based on the total mass of the undercoat layer was 100% by mass.

Example 2-52

An electrophotographic photoconductor of Example 2-52 was prepared as in Example 2-1 except that the undercoat layer was formed as below.

In a mixed solvent containing 200 parts of methanol and 200 parts of 1-butanol, 9 parts of the electron transport substance (A122), 11 parts of a polyamide resin (trade name: TRESIN EF30T, produced by Nagase ChemteX Corporation), and 0.1 part of zinc(II) octylate serving as a catalyst were dissolved so as to prepare a coating liquid for forming an undercoat layer. The coating liquid for forming an undercoat layer was applied to the conductive layer by dip-coating, and the resulting coating film was heated at 100° C. for 10 minutes. As a result, an undercoat layer having a thickness of 0.6 μm was obtained.

The amount PA of the electron transport substance based on the total mass of the undercoat layer was 45% by mass.

Example 2-53

An electrophotographic photoconductor of Example 2-53 was prepared as in Example 2-1 except that the undercoat layer was formed as follows.

In a mixed solvent containing 250 parts of tetrahydrofuran and 250 parts of cyclohexanone, 10 parts of the electron transport substance (A122), 23 parts of a crosslinking agent (B1:protective group (H5)), 3 parts of polyvinyl butyral (trade name: S-LEC BX-1, produced by Sekisui Chemical Co., Ltd.), and 0.15 part of zinc(II) octylate were dissolved to prepare a coating liquid for forming an undercoat layer. The coating liquid for forming an undercoat layer was applied to the conductive layer by dip-coating, and the resulting coating film was heated at 160° C. for 30 minutes. As a result, an undercoat layer having a thickness of 0.6 μm was obtained.

The amount PA of the electron transport substance based on the total mass of the undercoat layer was 28% by mass.

Example 2-54

An electrophotographic photoconductor of Example 2-54 was prepared as in Example 2-1 except that the undercoat layer was formed as described below.

To a 1 L sealable pressure glass container equipped with a stirrer and a heater, 90 parts of a polyolefin resin 2-propanol, 1.2 equivalent of triethylamine based on carboxyl groups in maleic anhydride contained in the resin, and 200 parts of distilled water were added. The resulting mixture was stirred by the stirrer with a stirring blade rotating at 300 rpm. The polyolefin resin was BONDINE HX-8290 (trade name) produced by Sumitomo Chemical Co., Ltd. As a result, no resin particle deposits were found on the bottom of the container and the resin particles were in a floating state. While maintaining this state, the mixture was heated by turning the heater on 15 minutes later. Then the mixture was stirred for 60 minutes while maintaining the temperature inside the system at 145° C. The resulting mixture was placed in a water bath, and cooled to room temperature (about 25° C.) while stirring at a rotation rate of 300 rpm. The resulting mixture was pressure-filtered (air pressure: 0.2 MPa) through a 300 mesh stainless steel filter (line diameter: 0.035 mm, plain weave). As a result, an even polyolefin resin dispersion having milky white color and a solid concentration of 20% by mass was obtained. The composition of the polyolefin resin was (P1)/(P2)/(P3)=80/2/18 (% by mass).

Formula (P1)

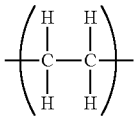

Formula (P2)

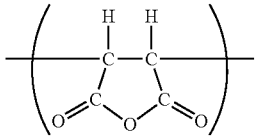

-continued

Formula (P3)

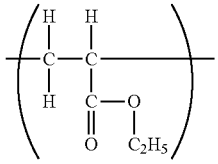

To a mixture containing 250 parts of 2-propanol and 150 parts of distilled water, 20 parts of the electron transport substance (A121), 50 parts of the polyolefin resin dispersion obtained, and 0.4 part of zinc(II) octylate were added, and the resulting mixture was processed for 2 hours in a sand mill charged with glass beads 1 mm in diameter. The resulting mixture was diluted with 250 parts of 2-propanol to dissolve the electron transport substance so as to prepare a coating liquid for forming an undercoat layer. The coating liquid for forming an undercoat layer was applied to the conductive layer by dip-coating, and the resulting coating film was heated at 90° C. for 20 minutes. As a result, an undercoat layer having a thickness of 0.6 μm was obtained.

The amount PA of the electron transport substance based on the total mass of the undercoat layer was 67% by mass.

Example 2-55

An electrophotographic photoconductor of Example 2-55 was prepared as in Example 2-1 except that the undercoat layer was formed as described below.

A copolymer of compounds represented by formulae (A1201) and (A1202) below was used as the electron transport substance. The copolymerization ratio was (A1201)/(A1202)=5/1 (molar ratio). The weight-average molecular weight was 10,000.

Formula (A1201)

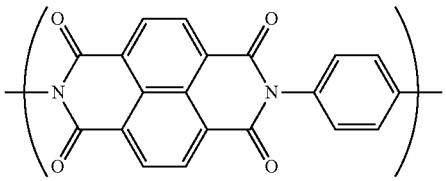

Formula (A1202)

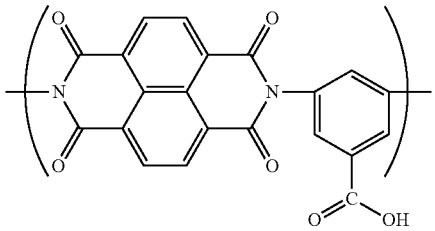

To a sand mill charged with glass beads 1 mm in diameter, 20 parts of the particles (electron transport pigment) of this copolymer of the electron transport substance, 0.01 part of zinc(II) octylate, and a dispersion medium containing 150 parts of distilled water, 250 parts of methanol, and 4 parts of triethylamine were added, and the resulting mixture was dispersed for 2 hours to prepare a coating liquid for an undercoat layer. The coating liquid for an undercoat layer was applied to the conductive layer by dip-coating, and the resulting coating film was heated at 120° C. for 10 minutes to fuse or agglomerate, and dry the electron transport pigment. As a result, an undercoat layer having a thickness of 0.6 μm was obtained.

The particle size of the electron transport pigment was measured before and after preparation of the coating liquid for forming an undercoat layer. The measurement was conducted by using a particle size distribution analyzer (trade name: CAPA700) produced by Horiba Ltd., by using methanol as a dispersion medium through a centrifugal precipitation method at a rotation speed of 7,000 rpm. The particle size was found to be 3.5 μm before preparation and 0.3 μm after preparation.

The amount PA of the electron transport substance based on the total mass of the undercoat layer was 100% by mass.

Comparative Example 2-1

The electron transport substance (A117) used to prepare the coating liquid for forming an undercoat layer in Example 2-1 was replaced with a compound represented by formula (J1) below. The hydroxygallium phthalocyanine crystal obtained in Example 1-1 used in preparing the coating liquid for forming a charge generation layer was replaced with the hydroxygallium phthalocyanine crystal obtained in Example 1-5. An electrophotographic photoconductor of Comparative Example 2-1 was prepared as in Example 2-1 except for these replacements. The compositions of the undercoat layer and the charge generation layer are shown in Tables 19-2 and 19-4.

Formula (J1)

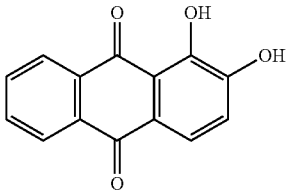

Comparative Example 2-2

An electrophotographic photoconductor of Comparative Example 2-2 was prepared as in Comparative Example 2-1 except that the coating liquid for forming an undercoat layer was prepared as follows.

A coating liquid for forming an undercoat layer was prepared by using 4 parts of a compound represented by formula (J2) below, 4.8 parts of a polycarbonate Z resin (type Z polycarbonate Iupilon 2400 produced by Mitsubishi Gas Chemical Company, Inc.), 100 parts of dimethylacetamide, and 100 parts of tetrahydrofuran. The compositions of the undercoat layer and the charge generation layer are shown in Tables 19-2 and 19-4.

Formula (J2)

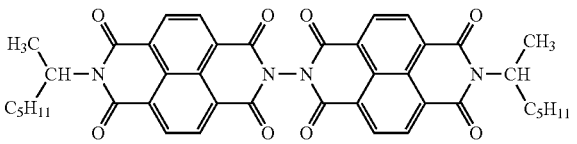

Comparative Example 2-3

An electrophotographic photoconductor of Comparative Example 2-3 was prepared as in Comparative Example 2-1 except that the compound represented by formula (J1) used in preparing the coating liquid for forming an undercoat layer in Comparative Example 2-1 was replaced with a compound represented by formula (J3) below. The compositions of the undercoat layer and the charge generation layer are shown in Tables 19-2 and 19-4.

Formula (J3)

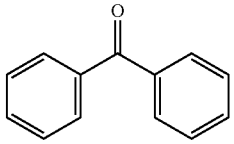

Comparative Example 2-4

An electrophotographic photoconductor of Comparative Example 2-4 was prepared as in Comparative Example 2-1 except that the undercoat layer was formed as described below. The compositions of the undercoat layer and the charge generation layer are shown in Tables 19-2 and 19-4.

In 480 parts of a methanol/n-butanol (2:1) mixed solution, 25 parts of N-methoxymethylated nylon 6 (trade name: TRESIN EF-30T, produced by Nagase ChemteX Corporation), and 15 parts of a compound represented by formula (J4) below were dissolved (dissolution under heating at 65° C.), and the resulting solution was cooled. The solution was filtered through a membrane filter (trade name: FP-022, pore size: 0.22 μm, produced by Sumitomo Electric Industries, Ltd.) to prepare a coating liquid for forming an undercoat layer. The coating liquid for forming an undercoat layer was applied to the conductive layer by dip-coating to form a coating film, and the coating film was heated and dried in an oven at 100° C. for 10 minutes. As a result, an undercoat layer having a thickness of 0.6 μm was formed.

Formula (J4)

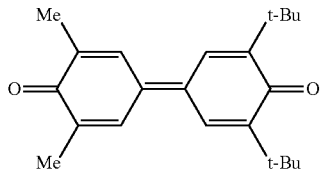

Comparative Example 2-5

An electrophotographic photoconductor of Comparative Example 2-5 was prepared as in Comparative Example 2-4 except that the compound represented by formula (J4) used in preparing the coating liquid for forming an undercoat layer in Comparative Example 2-4 was not used. The compositions of the undercoat layer and the charge generation layer are shown in Tables 19-2 and 19-4.

Comparative Example 2-6

An electrophotographic photoconductor of Comparative Example 2-6 was prepared as in Comparative Example 2-1 except that the charge generation layer was formed as described below. The compositions of the undercoat layer and the charge generation layer are shown in Tables 19-2 and 19-4.

Into a sand mill charged with glass beads 1 mm in diameter, 20 parts of a bisazo pigment represented by formula (J5) below, 0.5 part of N-methylformamide, 8 parts of polyvinyl butyral (trade name: S-LEC BX-1 produced by Sekisui Chemical Co., Ltd.), and 380 parts of cyclohexanone were placed, and the resulting mixture was dispersed for 20 hours. Thereto, 640 parts of ethyl acetate was added to prepare a coating liquid for forming a charge generation layer. The coating liquid for forming a charge generation layer was applied to the undercoat layer by dip-coating, and the resulting coating film was dried at 80° C. for 10 minutes. As a result, a charge generation layer having a thickness of 0.28 μm was obtained.

The amount PN of the amide compound represented by formula (N1) based on the total mass of the charge generation layer was 1.75% by mass. PN/PA was 0.040.

Formula (J5)

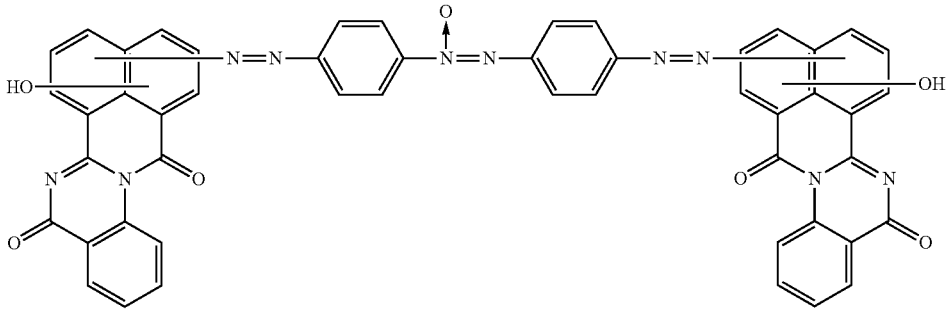

TABLE 19-1

| | Undercoat layer | | | | | | |
|---|---|---|---|---|---|---|---|
| | Type of composition | | | Compositional contents (parts) | | | |
| Examples | Electron transport substance | Crosslinking agent (protective group) | Resin | Electron transport substance | Crosslinking agent | Resin | PA |
| 2-1 | (A117) | B1 (H5) | D1 | 4.5 | 5.5 | 0.3 | 44% |
| 2-2 | (A117) | B1 (H5) | D1 | 4.5 | 5.5 | 0.3 | 44% |
| 2-3 | (A117) | B1 (H5) | D1 | 4.5 | 5.5 | 0.3 | 44% |
| 2-4 | (A117) | B1 (H5) | D1 | 4.5 | 5.5 | 0.3 | 44% |
| 2-5 | (A117) | B1 (H5) | D1 | 4.5 | 5.5 | 0.3 | 44% |
| 2-6 | (A117) | B1 (H5) | D1 | 4.5 | 5.5 | 0.3 | 44% |
| 2-7 | (A117) | B1 (H5) | D1 | 4.5 | 5.5 | 0.3 | 44% |
| 2-8 | (A117) | B1 (H5) | D1 | 4.5 | 5.5 | 0.3 | 44% |
| 2-9 | (A117) | B1 (H5) | D1 | 4.5 | 5.5 | 0.3 | 44% |
| 2-10 | (A117) | B1 (H5) | — | 5 | 5 | 0 | 50% |
| 2-11 | (A101) | B1 (H5) | D25 | 4 | 5.5 | 0.3 | 41% |
| 2-12 | (A101) | B1 (H5) | D25 | 4 | 5.5 | 0.3 | 41% |
| 2-13 | (A101) | B1 (H5) | D25 | 4 | 5.5 | 0.3 | 41% |
| 2-14 | (A101) | B1 (H5) | D25 | 4 | 5.5 | 0.3 | 41% |
| 2-15 | (A101) | B1 (H5) | — | 4 | 5.5 | 0 | 42% |
| 2-16 | (A101) | B1 (H1) | D25 | 5 | 4.5 | 0.5 | 50% |
| 2-17 | (A101) | B1 (H5) | D1 | 4 | 5.5 | 0.3 | 41% |
| 2-18 | (A101) | B1 (H5) | D3 | 4 | 5.5 | 0.3 | 41% |
| 2-19 | (A101) | B1 (H5) | D5 | 4 | 5.5 | 0.3 | 41% |
| 2-20 | (A101) | B1 (H5) | D18 | 4 | 5.5 | 0.3 | 41% |
| 2-21 | (A103) | B1 (H5) | D1 | 4 | 5.5 | 0.3 | 41% |
| 2-22 | (A104) | B1 (H5) | D1 | 4 | 5.5 | 0.3 | 41% |
| 2-23 | (A105) | B1 (H5) | D1 | 4 | 5.5 | 0.3 | 41% |
| 2-24 | (A109) | B1 (H5) | D1 | 4 | 5.5 | 0.3 | 41% |
| 2-25 | (A112) | B1 (H5) | D1 | 4 | 5.5 | 0.3 | 41% |
| 2-26 | (A115) | B1 (H5) | D1 | 4 | 5.5 | 0.3 | 41% |
| 2-27 | (A117) | B1 (H5) | D1 | 4 | 5.5 | 0.3 | 41% |
| 2-28 | (A202) | B1 (H5) | D25 | 4.5 | 5.5 | 0.3 | 44% |
| 2-29 | (A302) | B1 (H5) | D20 | 4.5 | 5.5 | 0.3 | 44% |
| 2-30 | (A303) | B1 (H5) | D25 | 4.5 | 5.5 | 0.3 | 44% |
| 2-31 | (A404) | B1 (H5) | D25 | 4.5 | 5.5 | 0.3 | 44% |
| 2-32 | (A504) | B1 (H5) | — | 5 | 5 | 0 | 50% |
| 2-33 | (A601) | B1 (H5) | D1 | 4.5 | 5.5 | 0.3 | 44% |
| 2-34 | (A705) | B1 (H5) | D1 | 4 | 5.5 | 0.3 | 41% |
| 2-35 | (A803) | B1 (H5) | — | 5 | 5 | 0 | 50% |
| 2-36 | (A902) | B1 (H1) | D25 | 4 | 5.5 | 0.3 | 41% |
| 2-37 | (A1002) | B1 (H5) | D25 | 4 | 5.5 | 0.3 | 41% |
| 2-38 | (A1101) | B1 (H5) | D1 | 4.5 | 5.5 | 0.3 | 44% |
| 2-39 | (A101) | C1-3 | D20 | 4 | 5.5 | 0.3 | 41% |
| 2-40 | (A114) | C1-1 | D1 | 5 | 4.5 | 0.5 | 50% |
| 2-41 | (A114) | C1-3 | D1 | 5 | 4.5 | 0.5 | 50% |
| 2-42 | (A117) | C2-4 | D22 | 5 | 4.5 | 0.5 | 50% |
| 2-43 | (A302) | C1-7 | D2 | 5 | 4.5 | 0.5 | 50% |
| 2-44 | (A117) | B15 (H1) | D25 | 4.5 | 5.5 | 0.3 | 44% |
| 2-45 | (A117) | B1 (H5) | D1 | 11 | 5.5 | 0.3 | 65% |
| 2-46 | (A117) | B1 (H5) | D1 | 11 | 4 | 0.3 | 72% |
| 2-47 | (A117) | B1 (H5) | D1 | 3 | 5.5 | 0.3 | 34% |
| 2-48 | (A117) | B1 (H5) | D1 | 2 | 5.5 | 0.3 | 26% |
| 2-49 | (A117) | B1 (H5) | D1 | 4.5 | 5.5 | 0.3 | 44% |
| 2-50 | (A302) | C1-7 | D2 | 5 | 4.5 | 0.5 | 50% |
| 2-51 | Polymer of (A124) | None | None | 6 | 0 | 0 | 100% |
| 2-52 | (A122) | None | Polyamide resin | 9 | 0 | 11 | 45% |
| 2-53 | (A122) | B1 (H5) | Butyral resin | 10 | 23 | 3 | 28% |
| 2-54 | (A121) | None | Polyolefin resin | 20 | 0 | 10 | 67% |
| 2-55 | (A1201), (A1202) | None | None | 20 | 0 | 0 | 100% |

TABLE 19-2

| | Undercoat layer | | | | | | |
|---|---|---|---|---|---|---|---|
| | Type of composition | | | Compositional contents (parts) | | | |
| Comparative Examples | Electron transport substance | Crosslinking agent (protective group) | Resin | Electron transport substance | Crosslinking agent | Resin | PA |
| 2-1 | (J1) | B1 (H5) | D1 | 4.5 | 5.5 | 0.3 | 44% |
| 2-2 | (J2) | None | Polycarbonate resin | 4 | 0 | 4.8 | 45% |
| 2-3 | (J3) | B1 (H5) | D1 | 4.5 | 5.5 | 0.3 | 44% |
| 2-4 | (J4) | None | Polyamide resin | 15 | 0 | 25 | 38% |
| 2-5 | None | None | Polyamide resin | 0 | 0 | 25 | 0% |
| 2-6 | (J1) | B1 (H5) | D1 | 4.5 | 5.5 | 0.3 | 44% |

TABLE 19-3

| | Charge generation layer | | | | |
|---|---|---|---|---|---|
| | Type of composition | | Amount | | |
| Example | Charge generation substance | Additive amide compound | of additive amide compound(parts) | PN | PN/PA |
| 2-1 | Example 1-1 | None | 0 | 0.37% | 0.008 |
| 2-2 | Example 1-1 | N-Methylformamide | 0.9 | 3.27% | 0.075 |
| 2-3 | Example 1-1 | N-Methylformamide | 1 | 3.58% | 0.082 |
| 2-4 | Example 1-2 | None | 0 | 0.47% | 0.011 |
| 2-5 | Example 1-3 | None | 0 | 1.40% | 0.032 |
| 2-6 | Example 1-4 | None | 0 | 2.20% | 0.050 |
| 2-7 | Example 1-5 | N-Methylformamide | 0.1 | 0.33% | 0.008 |
| 2-8 | Example 1-6 | None | 0 | 0.46% | 0.011 |
| 2-9 | Example 1-7 | None | 0 | 0.93% | 0.021 |
| 2-10 | Example 1-1 | None | 0 | 0.37% | 0.007 |
| 2-11 | Example 1-1 | None | 0 | 0.37% | 0.009 |
| 2-12 | Example 1-5 | N-Methylformamide | 0.05 | 0.17% | 0.004 |
| 2-13 | Example 1-5 | N-Methylformamide | 0.1 | 0.33% | 0.008 |
| 2-14 | Example 1-5 | N-Methylformamide | 1.2 | 3.85% | 0.094 |
| 2-15 | Example 1-5 | N-Methylformamide | 0.1 | 0.33% | 0.008 |
| 2-16 | Example 1-5 | N-Methylformamide | 0.1 | 0.33% | 0.007 |
| 2-17 | Example 1-1 | None | 0 | 0.37% | 0.009 |
| 2-18 | Example 1-1 | None | 0 | 0.37% | 0.009 |
| 2-19 | Example 1-1 | None | 0 | 0.37% | 0.009 |
| 2-20 | Example 1-1 | None | 0 | 0.37% | 0.009 |
| 2-21 | Example 1-1 | None | 0 | 0.37% | 0.009 |
| 2-22 | Example 1-1 | N-Propylformamide | 0.1 | 0.70% | 0.017 |
| 2-23 | Example 1-1 | N-Propylformamide | 0.8 | 2.95% | 0.072 |
| 2-24 | Example 1-1 | N-Propylformamide | 1 | 3.58% | 0.088 |
| 2-25 | Example 1-1 | N-Vinylformamide | 0.1 | 0.70% | 0.017 |
| 2-26 | Example 1-1 | N-Vinylformamide | 0.8 | 2.95% | 0.072 |
| 2-27 | Example 1-1 | N-Vinylformamide | 1 | 3.58% | 0.088 |
| 2-28 | Example 1-5 | N-Vinylformamide | 0.05 | 0.17% | 0.004 |
| 2-29 | Example 1-1 | None | 0 | 0.37% | 0.008 |
| 2-30 | Example 1-5 | N-Vinylformamide | 0.1 | 0.33% | 0.008 |
| 2-31 | Example 1-5 | N-Vinylformamide | 1 | 3.23% | 0.074 |
| 2-32 | Example 1-6 | N-Propylformamide | 1 | 3.67% | 0.073 |
| 2-33 | Example 1-7 | N-Propylformamide | 1 | 4.13% | 0.095 |
| 2-34 | Example 1-1 | None | 0 | 0.37% | 0.009 |
| 2-35 | Example 1-1 | None | 0 | 0.37% | 0.007 |
| 2-36 | Example 1-1 | None | 0 | 0.37% | 0.009 |
| 2-37 | Example 1-6 | N-Methylformamide | 0.1 | 0.79% | 0.019 |
| 2-38 | Example 1-7 | N-Vinylformamide | 0.1 | 1.26% | 0.029 |
| 2-39 | Example 1-2 | None | 0 | 0.47% | 0.011 |
| 2-40 | Example 1-3 | None | 0 | 1.40% | 0.032 |
| 2-41 | Example 1-4 | None | 0 | 2.20% | 0.050 |
| 2-42 | Example 1-5 | N-Methylformamide | 0.1 | 0.33% | 0.007 |
| 2-43 | Example 1-6 | None | 0 | 0.46% | 0.009 |
| 2-44 | Example 1-7 | None | 0 | 0.93% | 0.021 |
| 2-45 | Example 1-2 | None | 0 | 0.47% | 0.007 |
| 2-46 | Example 1-2 | None | 0 | 0.47% | 0.006 |
| 2-47 | Example 1-2 | None | 0 | 0.47% | 0.014 |
| 2-48 | Example 1-2 | None | 0 | 0.47% | 0.018 |
| 2-49 | Synthetic | N-Methylformamide | 0.1 | 0.33% | 0.008 |

TABLE 19-3-continued

| | Charge generation layer | | | | |
|---|---|---|---|---|---|
| | Type of composition | | Amount | | |
| Example | Charge generation substance | Additive amide compound | of additive amide compound(parts) | PN | PN/PA |
| 2-50 | Example 1 Synthetic | N-Methylformamide | 0.1 | 0.33% | 0.007 |
| 2-51 | Example 1 Example 1-1 | None | 0 | 0.37% | 0.004 |
| 2-52 | Example 1-1 | None | 0 | 0.37% | 0.008 |
| 2-53 | Example 1-1 | None | 0 | 0.37% | 0.013 |
| 2-54 | Example 1-1 | None | 0 | 0.37% | 0.006 |
| 2-55 | Example 1-1 | None | 0 | 0.37% | 0.004 |

TABLE 19-4

| Comparative Examples | Charge generation layer: Type of composition: Charge generation substance | Additive amide compound | Amount of additive amide compound(parts) | PN | PN/PA |
|---|---|---|---|---|---|
| 2-1 | Example 1-5 | None | 0 | 0.00% | 0.000 |
| 2-2 | Example 1-5 | None | 0 | 0.00% | 0.000 |
| 2-3 | Example 1-5 | None | 0 | 0.00% | 0.000 |
| 2-4 | Example 1-5 | None | 0 | 0.00% | 0.000 |
| 2-5 | Example 1-5 | None | 0 | 0.00% | |
| 2-6 | (J5) | N-Methylformamide | 0.5 | 1.75% | 0.040 |

Evaluation of Examples and Comparative Examples

The electrophotographic photoconductors of Examples and Comparative Examples were evaluated as to occurrence of ghosting in a 23° C./50% RH normal-temperature normal-humidity environment and a 15° C./10% RH low-temperature low-humidity environment. Evaluation of dark decay and sensitivity in a 23° C./50% RH normal-temperature normal-humidity environment was also conducted.

A laser beam printer (trade name: Color Laser Jet CP3525dn) produced by Hewlett-Packard Company was modified as follows and used as the electrophotographic apparatus used in evaluation. The modification was made so that the preexposure light did not turn on and that operation was conducted by varying conditions and laser exposure doses. The electrophotographic photoconductor prepared as described above was loaded onto a cyan process cartridge and the cyan process cartridge was attached to a station for a cyan process cartridge. The apparatus was operable without installing process cartridges of other colors (magenta, cyan, and black) onto the main body of the laser beam printer.

In outputting images, only the cyan process cartridge was installed onto the main body of the laser beam printer, and single-color images solely formed of a cyan toner were output.

The surface potential of the electrophotographic photoconductor was set so that the initial dark-area potential was −500 V and the light-area potential was −105 V.

In the measurement of the surface potential of the electrophotographic photoconductor for setting the potential, a potential probe (trade name: model 6000B-8, produced by Trek Japan Co., Ltd.) was attached to a development position of the process cartridge, and the potential at the center portion of the electrophotographic photoconductor in the longitudinal direction was measured with a surface electrometer (trade name: model 344, produced by Trek Japan Co., Ltd.).

Evaluation of Ghosting

Evaluation of ghosting was conducted first in a 23° C./50% RH normal-temperature normal-humidity environment. An endurance test involving passing of 1,000 sheets of paper was conducted in the same environment. Evaluation of ghosting was performed immediately after the completion of the endurance test. The evaluation results in the normal-temperature normal-humidity environment are shown in Tables 20-1 and 20-2.

Next, the electrophotographic photoconductor and the electrophotographic apparatus for evaluation were left in a 15° C./10% RH low-temperature low-humidity environment for 3 days, and then evaluation of ghosting was conducted. An endurance test involving passing of 1,000 sheets of paper was conducted in the same environment. Evaluation of ghosting was performed immediately after the completion of the endurance test. The evaluation results are shown in Tables 20-1 and 20-2.

In the endurance test, character "E" images having a printing ratio of 1% were formed on A4-size plain sheets of paper by using only the cyan color.

Figure 4:
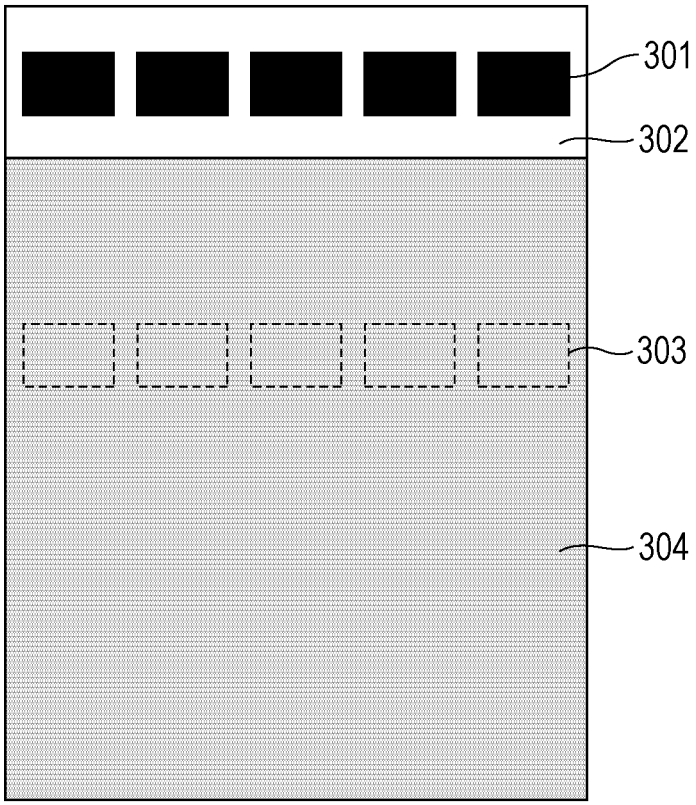
FIG. 4 is an image illustrating an image used for ghosting evaluation.

The evaluation criteria were as follows: The image used for ghosting evaluation was formed by outputting rectangles in solid black 301 in the upper portion of the image and then outputting a halftone image 304 having a 1-dot Keima pattern as shown in FIG. 4. The order of outputting images was as follows: a white solid image was output on the first sheet, the image for ghosting evaluation was consecutively output on 5 sheets, a solid black image was output on one sheet, and the image for ghosting evaluation was again consecutively output on 5 sheets. Evaluation was conducted on a total of 10 sheets that carried the image for ghosting evaluation.

Ghosting evaluation was performed by measuring the difference between the 1-dot Keima pattern image density and the image density of a ghosting portion (the portion where ghosting possibly occurs) with a spectrodensitometer (trade name: X-Rite 504/508, produced by X-Rite Inc.). The density was measured at 10 points for each sheet that carried the image for ghosting evaluation, and the average of the densities measured at 10 points was assumed to be the result of that sheet. The same measurement was conducted on all of the ten sheets that carried that image for ghosting evaluation, and the average thereof was calculated and assumed to be the difference in density of that Example or Comparative Example. A small difference in density means that the extent of ghosting is low and the quality is excellent. In Tables 20-1 and 20-2, "Initial" indicates the difference in density before the endurance test that involved passing of 1,000 sheets of paper in the normal-temperature normal-humidity environment or the low-temperature low-humidity environment; and "After endurance" indicates the difference in density after the endurance test that involved passing of 1,000 sheets of paper in the normal-temperature normal-humidity environment or the low-temperature low-humidity environment.

Evaluation of Dark Decay

Dark decay was measured with a drum tester SYNTHIA 90 produced by Gen-Tech Inc. A corona charger was used for charging.

First, the charger was set so that the surface potential 0.1 second after charging was −500 V.

Charging was conducted again under the same settings and conditions. The surface potential 0.1 second after charging and the surface potential 1.0 second after charging were measured, and the ratio of the surface potential 1.0 second after to the surface potential 0.1 second after was assumed to be the dark decay (%). The evaluation results for the dark decay (%) are shown in Tables 20-1 and 20-2.

Evaluation of Sensitivity

Sensitivity was evaluated on the basis of the light-area potential after irradiation at the same quantity of light. A low light-area potential indicates excellent sensitivity, and a high light-area potential indicates poor sensitivity.

Charging was conducted so that the initial dark-area potential was −500 V, the quantity of light was set to 0.3 μJ/cm2, and the light-area potential was measured. The evaluation results for the light-area potential are shown in Tables 20-1 and 20-2.

TABLE 20-1

| | Difference in density | | | | | |
|---|---|---|---|---|---|---|
| | Normal-temperature normal-humidity environment | | Low-temperature low-humidity environment | | Dark | Light-area |
| Examples | Initial | After endurance | Initial | After endurance | decay [%] | potential [V] |
| 2-1 | 0.019 | 0.018 | 0.022 | 0.022 | 99 | −143 |
| 2-2 | 0.019 | 0.020 | 0.021 | 0.024 | 99 | −145 |
| 2-3 | 0.019 | 0.022 | 0.023 | 0.028 | 98 | −146 |
| 2-4 | 0.020 | 0.020 | 0.022 | 0.025 | 98 | −146 |
| 2-5 | 0.019 | 0.020 | 0.024 | 0.026 | 98 | −147 |
| 2-6 | 0.020 | 0.023 | 0.024 | 0.028 | 97 | −150 |
| 2-7 | 0.022 | 0.022 | 0.024 | 0.028 | 97 | −158 |
| 2-8 | 0.021 | 0.023 | 0.023 | 0.027 | 98 | −151 |
| 2-9 | 0.020 | 0.022 | 0.025 | 0.027 | 98 | −153 |
| 2-10 | 0.019 | 0.019 | 0.022 | 0.024 | 99 | −142 |
| 2-11 | 0.020 | 0.018 | 0.022 | 0.022 | 99 | −144 |
| 2-12 | 0.023 | 0.033 | 0.025 | 0.035 | 98 | −158 |
| 2-13 | 0.021 | 0.022 | 0.025 | 0.029 | 99 | −154 |
| 2-14 | 0.028 | 0.038 | 0.027 | 0.037 | 98 | −160 |
| 2-15 | 0.021 | 0.024 | 0.024 | 0.028 | 99 | −155 |
| 2-16 | 0.021 | 0.023 | 0.025 | 0.029 | 99 | −155 |
| 2-17 | 0.020 | 0.020 | 0.022 | 0.024 | 99 | −141 |
| 2-18 | 0.020 | 0.020 | 0.022 | 0.023 | 99 | −144 |
| 2-19 | 0.020 | 0.018 | 0.022 | 0.024 | 99 | −143 |
| 2-20 | 0.019 | 0.020 | 0.022 | 0.023 | 99 | −143 |
| 2-21 | 0.020 | 0.020 | 0.022 | 0.024 | 99 | −142 |
| 2-22 | 0.019 | 0.019 | 0.023 | 0.025 | 98 | −145 |
| 2-23 | 0.018 | 0.021 | 0.023 | 0.024 | 98 | −145 |
| 2-24 | 0.020 | 0.024 | 0.024 | 0.029 | 97 | −148 |
| 2-25 | 0.020 | 0.019 | 0.023 | 0.025 | 99 | −145 |
| 2-26 | 0.020 | 0.021 | 0.022 | 0.025 | 99 | −146 |
| 2-27 | 0.020 | 0.023 | 0.022 | 0.029 | 97 | −147 |
| 2-28 | 0.028 | 0.039 | 0.026 | 0.037 | 97 | −156 |
| 2-29 | 0.020 | 0.019 | 0.023 | 0.024 | 99 | −144 |
| 2-30 | 0.029 | 0.026 | 0.026 | 0.032 | 97 | −155 |
| 2-31 | 0.028 | 0.026 | 0.027 | 0.032 | 97 | −163 |
| 2-32 | 0.022 | 0.024 | 0.025 | 0.029 | 96 | −150 |
| 2-33 | 0.023 | 0.032 | 0.026 | 0.035 | 96 | −151 |
| 2-34 | 0.019 | 0.020 | 0.021 | 0.023 | 99 | −144 |
| 2-35 | 0.019 | 0.020 | 0.022 | 0.024 | 99 | −143 |
| 2-36 | 0.019 | 0.020 | 0.023 | 0.024 | 99 | −144 |
| 2-37 | 0.020 | 0.021 | 0.024 | 0.027 | 98 | −150 |
| 2-38 | 0.021 | 0.023 | 0.025 | 0.029 | 97 | −155 |
| 2-39 | 0.020 | 0.021 | 0.024 | 0.025 | 98 | −145 |
| 2-40 | 0.020 | 0.021 | 0.023 | 0.026 | 97 | −149 |
| 2-41 | 0.020 | 0.021 | 0.023 | 0.026 | 97 | −156 |
| 2-42 | 0.021 | 0.022 | 0.024 | 0.028 | 98 | −155 |
| 2-43 | 0.021 | 0.023 | 0.024 | 0.028 | 97 | −155 |
| 2-44 | 0.020 | 0.022 | 0.025 | 0.026 | 97 | −158 |
| 2-45 | 0.020 | 0.020 | 0.022 | 0.026 | 94 | −160 |
| 2-46 | 0.021 | 0.023 | 0.023 | 0.026 | 93 | −163 |
| 2-47 | 0.019 | 0.020 | 0.024 | 0.025 | 93 | −161 |
| 2-48 | 0.021 | 0.021 | 0.024 | 0.028 | 92 | −167 |
| 2-49 | 0.022 | 0.028 | 0.035 | 0.049 | 98 | −171 |

TABLE 20-1-continued

| | Difference in density | | | | | |
|---|---|---|---|---|---|---|
| | Normal-temperature normal-humidity environment | | Low-temperature low-humidity environment | | Dark | Light-area |
| Examples | Initial | After endurance | Initial | After endurance | decay [%] | potential [V] |
| 2-50 | 0.023 | 0.029 | 0.036 | 0.050 | 97 | −173 |
| 2-51 | 0.022 | 0.032 | 0.025 | 0.036 | 95 | −154 |
| 2-52 | 0.020 | 0.029 | 0.023 | 0.041 | 96 | −143 |
| 2-53 | 0.021 | 0.026 | 0.023 | 0.032 | 93 | −150 |
| 2-54 | 0.021 | 0.025 | 0.023 | 0.029 | 91 | −149 |
| 2-55 | 0.022 | 0.033 | 0.025 | 0.035 | 90 | −158 |

TABLE 20-2

| | Difference in density | | | | | |
|---|---|---|---|---|---|---|
| | Normal-temperature normal-humidity environment | | Low-temperature low-humidity environment | | Dark | Light-area |
| Comparative Examples | Initial | After endurance | Initial | After endurance | decay [%] | potential [V] |
| 2-1 | 0.036 | 0.058 | 0.050 | 0.098 | 96 | −188 |
| 2-2 | 0.041 | 0.067 | 0.055 | 0.109 | 98 | −191 |
| 2-3 | 0.035 | 0.059 | 0.051 | 0.104 | 96 | −190 |
| 2-4 | 0.033 | 0.069 | 0.044 | 0.111 | 97 | −186 |
| 2-5 | 0.036 | 0.064 | 0.046 | 0.120 | 96 | −184 |
| 2-6 | 0.031 | 0.066 | 0.053 | 0.125 | 94 | −197 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039415, filed Feb. 27, 2015, which is hereby incorporated by reference herein in its entirety.

What is claimed is:

1. An electrophotographic photoconductor comprising:

a support;

an undercoat layer;

a charge generation layer; and a hole transport layer in this order, wherein the undercoat layer comprises a polymerized product of a composition that comprises an electron transport substance haying a polymerizable group and a crosslinking agent, and the charge generation layer comprises a gallium phthalocyanine crystal and an amide compound represented by formula (N1):

Formula (N1)

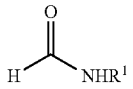

where $R^1$ represents a methyl group, and wherein PN/PA is 0.005 or more and 0.080 or less, where PA represents an amount of the electron transport substance in terms of percent by mass based on a total mass of the undercoat layer and PN represents an amount of the amide compound represented by formula (N1) in terms of percent by mass based on a total mass of the charge generation layer.

2. The electrophotographic photoconductor according to claim 1, wherein an amount of the amide compound represented by formula (N1) is 0.1% by mass or more and 3.0% by mass or less based on a total mass of the charge generation layer.

3. The electrophotographic photoconductor according to claim 1, wherein the amide compound represented by formula (N1) is contained inside the gallium phthalocyanine crystal.

4. The electrophotographic photoconductor according to claim 3, wherein an amount of the amide compound represented by formula (N1) contained inside the gallium phthalocyanine crystal is 0.1% by mass or more and 3.0% by mass or less based on an amount of the gallium phthalocyanine crystal.

5. The electrophotographic photoconductor according to claim 1, wherein the gallium phthalocyanine crystal is a hydroxygallium phthalocyanine crystal that has a crystal form that has peaks at Bragg angles 2θ of 7.4°±0.3° and 28.2°±0.3° in X-ray diffraction with a Cu Kα radiation.

6. The electrophotographic photoconductor according to claim 1, wherein an amount of the electron transport substance is 30% by mass or more and 70% by mass or less based on a total mass of the undercoat layer.

7. A process cartridge detachably attachable to a main body of an electrophotographic apparatus, comprising:

an electrophotographic photoconductor; and at least one device selected from the group consisting of a charging device, a developing device, and a cleaning device, wherein the electrophotographic photoconductor and the at least one device selected from the group consisting of a charging device, a developing device, and a cleaning device are integrally supported, the electrophotographic photoconductor comprises a support, an undercoat layer, a charge generation layer, and a hole transport layer in this order, the undercoat layer comprises a polymerized product and the charge generation layer comprises a gallium phthalocyanine crystal and an amide compound represented by formula (N1):

Formula (N1)

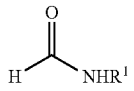

where $R^1$ represents a methyl group, and wherein PN/PA is 0.005 or more and 0.080 or less, where PA represents an amount of the electron transport substance in terms of percent by mass based on a total mass of the undercoat layer and PN represents an amount of the amide compound represented by formula (N1) in terms of percent by mass based on a total mass of the charge generation layer.

8. An electrophotographic apparatus comprising:

an electrophotographic photoconductor;

a charging device;

an exposing device;

a developing device; and a transfer device, wherein the electrophotographic photoconductor comprises a support, an undercoat layer, a charge generation layer, and a hole transport layer in this order, the undercoat layer comprises a polymerized product, and the charge generation layer comprises a gallium phthalocyanine crystal and an amide compound represented by formula (N1):

Formula (N1)

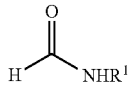

where $R^1$ represents a methyl group, and wherein PN/PA is 0.005 or more and 0.080 or less, where PA represents an amount of the electron transport substance in terms of percent by mass based on a total mass of the undercoat layer and PN represents an amount of the amide compound represented by formula (N1) in terms of percent by mass based on a total mass of the charge generation layer.

* * * * *